US005896073A

United States Patent [19]

Miyazaki et al.

[11] Patent Number: 5,896,073

[45] Date of Patent: Apr. 20, 1999

[54] HIGH FREQUENCY FILTER HAVING A PLURALITY OF SERIALLY COUPLED FIRST RESONATORS AND A SECOND RESONATOR

[75] Inventors: Moriyasu Miyazaki; Naofumi Yoneda; Tamotsu Nishino, all of Tokyo, Japan

[73] Assignee: Mitsubishi Denki Kabushiki Kaisha, Tokyo, Japan

[21] Appl. No.: 08/808,987

[22] Filed: Feb. 20, 1997

[30] Foreign Application Priority Data

Feb. 20, 1996 [JP] Japan ..... 8-032283

[51] Int. Cl.[6] ..... H01P 1/203

[52] U.S. Cl. ..... 333/204; 333/205

[58] Field of Search ..... 333/202, 204, 333/205, 206

[56] References Cited

U.S. PATENT DOCUMENTS

| | | | |
|---|---|---|---|
| 4,418,324 | 11/1983 | Higgins | 333/204 |
| 4,423,396 | 12/1983 | Makimoto et al. | 333/204 |
| 5,344,695 | 9/1994 | Hirai et al. | 333/205 |
| 5,525,942 | 6/1996 | Horii et al. | 333/134 |
| 5,543,764 | 8/1996 | Turunen et al. | 333/202 |
| 5,648,747 | 7/1997 | Grothe et al. | 333/204 |

FOREIGN PATENT DOCUMENTS

| | | | |
|---|---|---|---|
| 1-101603 | 7/1989 | Japan . | |
| 6-97702 | 4/1994 | Japan | 333/204 |

*Primary Examiner*—Seungsook Ham

[57] ABSTRACT

A high frequency filter includes a dielectric plate 8, an outer conductor 9 formed on the one surface of the dielectric plate 8, a plurality of strip conductors 10*a*–10*d* formed approximately in parallel on the other surface of the dielectric plate 8, a strip conductor 15 formed in a direction crossing the strip conductors 10*a*–10*d*, short-circuiting portions 11 and 16 connecting the one ends of the strip conductors 10*a*–10*d* and the strip conductor to the outer conductor 9, respectively, and further comprises a plurality of resonators 110*a*–110*d* constructed by the strip conductors 10, a plurality of capacitors (gaps) 12 coupling the resonators to each other to be connected in series, capacitors 13 connecting the strip conductors 10*a*, 10*d* to an input terminal and an outer conductor, respectively, a resonator 200 constructed by the strip conductor 15, and a plurality of capacitors (gaps) 33 connecting the strip conductors 10*a*, 10*d* to the resonator 200.

9 Claims, 18 Drawing Sheets

HIGH FREQUENCY FILTER HAVING A PLURALITY OF SERIALLY COUPLED FIRST RESONATORS AND A SECOND RESONATOR

BACKGROUND OF THE INVENTION

1. Field of the Invention

The present invention relates to a high frequency filter mainly used in a VHF band, UHF band, a microwave band and a millimeter wave band and more particularly to polarize it and improve its characteristic.

2. Description of the Related Art

FIG. 33 is a schematic diagram showing a conventional high frequency filter disclosed in e.g. Japanese Utility Model Unexamined Publication No. Hei 1-101603.

In the figure, reference numeral 8*c* denotes a dielectric block.

Reference numeral 9 denotes one of outer conductors each made of a conductive film formed on the remaining sides other than one side (upper side in the figure) of all the sides of the dielectric block 8*c*. The outer conductors are in intimate contact with the outer wall of the dielectric block 8*c*.

Reference numeral 10*c* denotes one of inner conductors each made of a conductive film formed in intimate contact with the inner wall of each of first through-holes 23 described later. The inner conductors 10*c* are continuously connected to the outer conductors 9 on the outer wall of the dielectric block 8*c* at their one ends (the bottom side in the figure).

Reference numeral 23 denotes one of first four through-holes passing through between opposite faces of the dielectric block 8*c* (upper face and bottom face) and arranged in substantially parallel. The first through-holes 23 are arranged in substantially parallel to the remaining faces (side faces in the figure).

Reference numeral 24 denotes one of three second through-holes formed in the same manner as the first through-holes 23 and arranged in substantially parallel between the adjacent first through-holes 23. Each second through-hole 24 has a smaller diameter than that of each first through-hole 23.

The inner conductors 10*c*, first through-holes 23 and second through-holes 24 constitute ¼ wavelength resonators 120*a* to 120*d* with their one ends opened and other ends short-circuited.

Reference numeral 25 denotes one of first electrodes formed on the surface of the dielectric block 8*c* at the open ends (upper side in the figure) of the ¼ wavelength resonators 120*a* and 120*d* at both ends. Each first electrode is continuously connected to each inner conductor 10*c*.

Reference numeral 26 denotes a dielectric plate having substantially the same shape as the one side (upper face in the figure) of the dielectric block 8*c*. The dielectric plate 26 is overlaid on this surface of the dielectric block 8*c*.

Reference numeral 27 denotes one of third through-holes provided on the dielectric plate 26 so as to coincide with the opening positions of the first through-holes 23 at the open ends of the ¼ wavelength resonators 120*a* and 120*b* at both ends.

Reference 28 denotes one of second electrodes each made of a conductive film in intimate contact with the surface of the dielectric plate 26 and formed on the periphery of each of the second though-hole at both ends.

Reference numeral 29 denotes a conductor for connecting said second electrodes 28 to each other.

Reference numeral 30 denotes a dielectric tube, and P1 and P2 denote terminals provided on the dielectric tube 30, respectively.

Each first electrode 25 and each second electrode 28 are opposite to each other through the dielectric plate 26 to constitute a capacitor. The terminal P1 and the terminal P2 are partially inserted into dielectric tubes 30, respectively and into the through-holes 23 at both ends. Thus, the inner conductor 10*c*, dielectric tube 30, terminal P1 or P2 constitute a capacitor for input/output coupling.

An explanation will be given of the operation theory. First, the presence of the second through-holes 24 generates inequality in permittivity within the dielectric block 8*c*. This inductively couples the adjacent resonators to each other by mainly a magnetic field. The amount of coupling can be adjusted by the distance between the resonators 120 and size of the second through-hole 24. The resonators 120*a* and 120*d* at both ends are mainly inductively coupled with each other through the intermediate resonators 120*b* and 120*c*, and also slightly capacitively coupled with each other through the first electrodes 25, second electrode 27 and connecting conductor 29.

Now it is assumed that the length of the inner conductor 10*c* is adjusted so that the four resonators 120*a* to 120*d* are resonated at the same frequency f0. On this assumption, at the frequency f0, the four resonators in a resonance state are strongly inductively coupled with one another. Thus, a wave incident to the terminal P1 is guided to the resonator 120*d* through the resonators 120*a* to 120*c* and taken out from the terminal P2. On the other hand, at the frequency other than f0, the resonators 120*a* to 120*d* are very weakly coupled with one another so that most of the electric power of the incident wave to the input/output terminals is reflected. In this way, the conventional high frequency filter as shown in FIG. 33 can serve as a band-pass filter.

In the high frequency filter as shown in FIG. 33, the resonators 120*a* and 120*d* at both ends are mainly coupled with each other through the intermediate resonators 120*b* and 120*c* and also slightly capacitively jumping-coupled with each other by the first electrodes 25, second electrodes 27 and connecting conductor 29. Generally, the passing phase of the resonator is +90° at the frequency lower than the resonance frequency, 0° at the resonance frequency and −90° at the frequency higher than the resonance frequency. The passing phase of the capacitive coupling means in series connection is +90° whereas that of the inductive coupling means in series connection is −90°. In the main coupling between the resonators 120*a* and 120*d* at both ends, which passes through two resonators and three stages of inductive coupling means, the total passing phase is −90° at the frequency lower than f0 and −450° (=−90°) at the frequency higher than f0.

On the other hand, since the jumping-coupling is capacitive, the passing phase due to it is +90° irrespectively of the frequency. Thus, in the conventional high frequency filter as shown in FIG. 33, the passing phase due to the main coupling and that due to the jumping-coupling are opposite. For this reason, attenuation poles are generated in the frequencies lower and higher than the passing band, thereby making the attenuation characteristic abrupt. In this case, the amount of jumping which is very little has little effect on the loss of the passing band.

In order that the jumping-coupling is capacitive, it should be noted that the electric length of a connecting conductor must be much shorter than the wavelength, and in FIG. 33, the permittivity of the dielectric plate 26 must be much smaller than that of the dielectric block 8*c*.

FIG. 34 is a schematic diagram showing the conventional high frequency filter disclosed in J-UM-3-44304, for example.

In the figure, reference numeral 8 denotes a dielectric plate.

Reference numeral 9 denotes an outer conductor of a conductive film formed in intimate contact with the one entire surface (bottom surface in the figure) of the dielectric plate 8.

Reference numeral 10 denotes one of strip conductors of a conductor film arranged in parallel and formed in intimate contact with the other surface (upper surface in the figure) of the dielectric plate.

Reference numeral 11 denotes a short-circuiting end surface of a conductive film formed in intimate contact with the side surface of the dielectric plate and continuously connected to the outer conductor 9 and strip conductors 10.

The dielectric plate 8, outer conductor 9, strip conductors 10 and short-circuiting end surface 11 constitute an approximately ¼ wavelength microstrip line type resonator 110 with the one end opened and other end short-circuited.

Reference numeral 13 denotes one of capacitors provided on the strip conductors 10, respectively.

Reference numeral 14 denotes one of conductor ribbons each having the one end connected to the capacitor 13 and the other end connected to a strip conductor 31 described below.

Reference numeral 31 denotes the strip conductor of a conductor film in intimate contact with the other surface (upper surface in the figure) of the dielectric plate 8. The strip conductor 31 is arranged in a direction crossing the strip conductors 10 in the vicinity of the open ends of the strip conductors where the capacitors 13 are provided.

The dielectric plate 8, outer conductor 9 and strip conductor 31 constitute a main line 32.

Reference symbols P1 and P2 denote terminals, respectively. The open ends of the two strip conductors are connected to the strip conductor 31, with a distance of approximately ¼ wavelength therebetween, through the capacitors 13 and conductor ribbons 14.

In operation, assuming that the resonance frequency of the resonator 110 is f0, at the frequency lower than f0, the resonator 110 serves as an inductance to constitute a series resonance circuit together with a capacitor 13. Now assuming that the series resonance frequency is f1, most of the electric power of the incident wave at the frequency of f1 incident on the terminal P1 is reflected owing to the resonance in the series resonance circuit. On the other hand, at the frequency other than f1, without being influenced by the resonators 110, most of the electric power of the incident wave on the terminal P1 is guided to the terminal P2. In this way, the conventional high frequency filter as shown in FIG. 34 serves as a band-stop filter.

Since the high frequency filter is constructed as described, where the resonators 120*a* to 120*d* and the jumping-coupling means such as the electrodes 25 and 27 are formed on the same dielectric block or plate, or otherwise the permittivity of the dielectric material constituting a filter is relatively small, the electric length of the connection line (connection line 29) of the jumping connecting means becomes fairly long, thus making it impossible to form a desired attenuation pole.

In connection between the strip conductors 10 and strip conductor 31, in addition to the connection in the manner of a lumped constant circuit by the capacitors 13, the direct connection by fringing is provided so that both strip conductors cannot be arranged adjacently to each other. For this reason, the conductor ribbons are required for connecting the capacitors 13 to the strip conductors 31. This makes the assembling of the high frequency filter complicated.

SUMMARY OF THE INVENTION

The present invention has been accomplished to solve the above problems, and therefore an object of the present invention is to provide a high frequency filter which can form a desired pole in a passing characteristic and can be easily assembled where the resonators and the jumping coupling means in a filter are formed on the same dielectric plate, or otherwise the permittivity of the dielectric material constituting the filter is relatively small.

A high frequency filter according to the present invention comprises an input terminal and an output terminal; a plurality of first resonators; a plurality of main coupling means for coupling said plurality of resonators with each other to be connected in series; a plurality of input/output coupling means for connecting both ends of said first resonators connected in series to said input terminal and said output terminal, respectively; a second resonator; and a plurality of jumping coupling means for coupling those located at both ends of said first resonators connected in series with said second resonator.

In this configuration, the passing phases via the main connecting means and the jumping connection means are made opposite to each other at both frequency ranges lower and higher than the passing frequency band.

In the high frequency filter defined in the present invention, at least even number of said plurality of main coupling means are capacitive coupling means and the resonance frequency of said second resonator is set to be higher than that of said first resonators.

In the high frequency filter according to the present invention, at least even number of said plurality of main coupling means are inductive coupling means and the resonance frequency of said second resonator is set to be lower than that of said first resonators.

In the high frequency filter according to the present invention, the number of said first resonators is three or more, and the resonance frequency of said second resonator is set to be higher than that of said first resonators.

In the high frequency filter according to the present invention, the number of said first resonators is three or more, and the resonance frequency of said second resonator is set to be lower than that of said first resonators.

The high frequency filter according to the present invention comprises a dielectric plate; an outer conductor formed on the one surface of said dielectric plate; a plurality of first strip conductors formed on the other surface of said dielectric plate and arranged in substantially parallel to each other; a second strip conductor formed in a direction crossing said first strip conductors; and a first short-circuiting portion and a second short-circuiting portion for connecting the one end of said first strip conductors and the one end of said second strip conductor to said outer conductor, respectively, each of said first resonators includes said dielectric plate, said outer conductor, each of said first strip conductors and said first short-circuit portion; and said second resonator includes said dielectric plate, said outer conductor, said second strip conductors and said second short-circuit portion.

In this configuration, even when the distance between the two resonators to be jumping connected is approximately equal to the length of the second resonator constructed by the second strip line, the difference between the passing phase by the main coupling and the jumping connection can be set for a desired value.

In the high frequency filter according to the present invention, said second strip conductor is provided with a tip-short-circuited stub branching from its intermediate portion and having a tip connected to said outer conductor to be short-circuited.

In this configuration, even when the distance between the two resonators to be jumping connected is approximately equal to the length of the second resonator constructed by the second strip line, the difference between the passing phase by the main coupling and the jumping connection can be set for a desired value.

By varying the position or length of the tip-short-circuited stub, the resonance frequency of the second resonator can be varied.

In the high frequency filter according to the present invention, said second strip conductor is provided with a tip-opened stub branching from its intermediate portion and having an opened tip.

In this configuration, even when the distance between the two resonators to be jumping connected is approximately equal to the length of the second resonator constructed by the second strip line, the difference between the passing phase by the main coupling and the jumping connection can be set for a desired value.

By varying the position or length of the tip-short-circuited stub, the resonance frequency of the second resonator can be varied.

In the high frequency filter according to the present invention, said second short-circuiting portion connects both ends of said second strip conductor to said outer conductor.

In this configuration, even when the distance between the two resonators to be jumping connected is approximately equal to the length of the second resonator constructed by the second strip line, the difference between the passing phase by the main coupling and the jumping connection can be set for a desired value.

In the high frequency filter according to the present invention, both ends of said second strip conductor are opened.

In this configuration, even when the distance between the two resonators to be jumping connected is approximately equal to the length of the second resonator constructed by the second strip line, the difference between the passing phase by the main coupling and the jumping connection can be set for a desired value.

In the high frequency filter according to the present invention, said second strip conductor is provided with a tip-short-circuited stub branching from its intermediate portion and having a tip connected to said outer conductor to be short-circuited.

In this configuration, even when the distance between the two resonators to be jumping connected is approximately equal to the length of the second resonator constructed by the second strip line, the difference between the passing phase by the main coupling and the jumping connection can be set for a desired value.

By varying the position or length of the tip-short-circuited stub, the resonance frequency of the second resonator can be varied.

In the high frequency filter according to the present invention, said second strip conductor is provided with a tip-opened stub branching from its intermediate portion and having an opened tip.

In this configuration, even when the distance between the two resonators to be jumping connected is approximately equal to the length of the second resonator constructed by the second strip line, the difference between the passing phase by the main coupling and the jumping connection can be set for a desired value.

By varying the position or length of the tip-short-circuited stub, the resonance frequency of the second resonator can be varied.

The high frequency filter according to the present invention comprises a connecting conductor for connecting the adjacent first strip conductors to each other; and a plurality of jumping coupling means for coupling the first resonators located at both ends of said plurality of first resonators to said plurality of second resonators to one another, respectively.

In this configuration, even when the distance between the two resonators to be jumping connected is approximately equal to the length of the second resonator constructed by the second strip line, the difference between the passing phase by the main coupling and the jumping connection can be set for a desired value.

The high frequency filter according to the present invention comprises a first dielectric plate; a first outer conductor formed on the one surface of said first dielectric plate; a plurality of first strip conductors formed on the other surface of said first dielectric plate and arranged in substantially parallel to each other and having one ends connected to said first conductor to be short-circuited; a second dielectric plate; a second outer conductor formed on the one surface of said second dielectric plate; a plurality of second strip conductors formed on the other surface of said first dielectric plate and having substantially the same shape as that of each of said first strip conductors;

said first resonators are configured as-a plurality of tri-plate line type resonators by stacking said first and second dielectric plates so that said first and said second strip conductors are opposite and overlay each other; and in order to short-circuit said strip conductors, a conductor foil or conductor plate is provided on the sides of said first and second dielectric plate.

Since said conductor foil or conductor plate is soldered using e.g. cream solder or plate solder, said first and said second dielectric plate can be mechanically connected to each other and the electric connection between the outer conductor and strip conductor can be strengthened.

In the high frequency filter according to the present invention, narrow-width portions are provided at the terminals of those located at both ends of said first strip conductors and extended to the vicinity of an input/output line; and said input/output lines and said narrow-width portions are connected to each other by capacitors each serving as said input/output coupling means.

Said narrow-width portions extended to the vicinity of the input/output line permits the distance between the said input/output line and the resonators to be reduced without increasing unnecessary connection therebetween.

The high frequency filter according to the present invention comprises:

a strip line type resonator including a dielectric plate, an outer conductor formed on the one surface of said dielectric plate, and a first strip conductor formed on the other surface of said dielectric plate;

a main line of a strip line including said dielectric plate, said outer conductor and a second strip conductor formed on the other surface of said dielectric plate and arranged with an orientation crossing said strip line type resonator in the vicinity of the open end of said strip line type resonator; and a capacitor serving as means for coupling said strip line type resonator with the main line of said strip line, and a narrow-width portion of said strip conductor is provided at the open end of said strip line resonator and extended to the vicinity of said main line, and said main line and said narrow-width portion are connected to each other by a capacitor.

The connection between the main line and the narrow-width portion extended to the vicinity of the input/output line through said capacitor permits the distance between the said input/output line and the resonators to be reduced without increasing unnecessary connection therebetween.

The above and other objects and features of the present invention will be more apparent from the following description taken in conjunction with the accompanying drawings.

DETAILED DESCRIPTION OF THE PREFERRED EMBODIMENTS

Now, a description will be given in more details of the preferred embodiments of the present invention with reference to the accompanying drawings.

(Embodiment 1)

Figure 1:
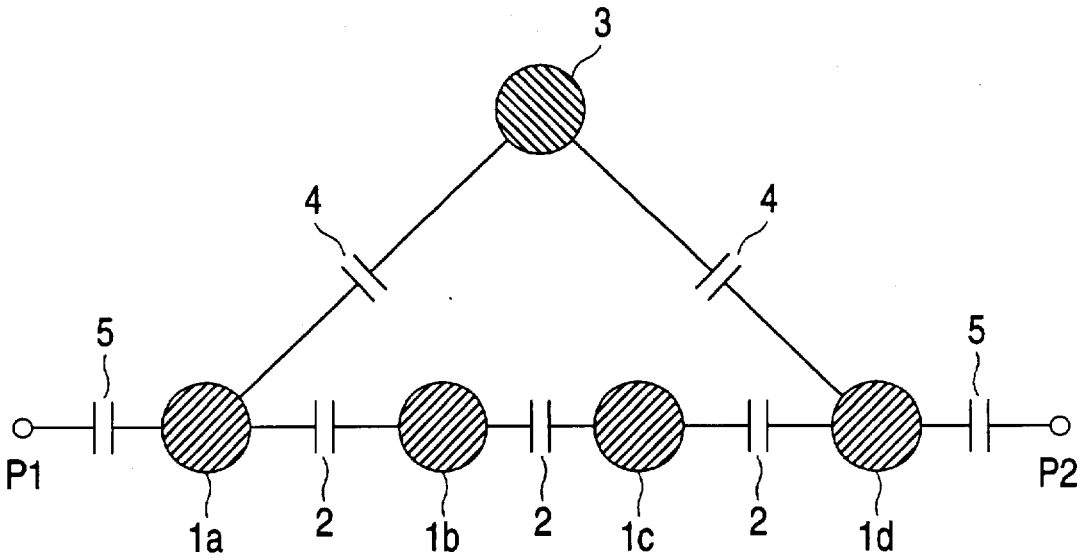
FIG. 1 is a schematic diagram of a high frequency filter according to the first embodiment of the present invention.
Figure 2:
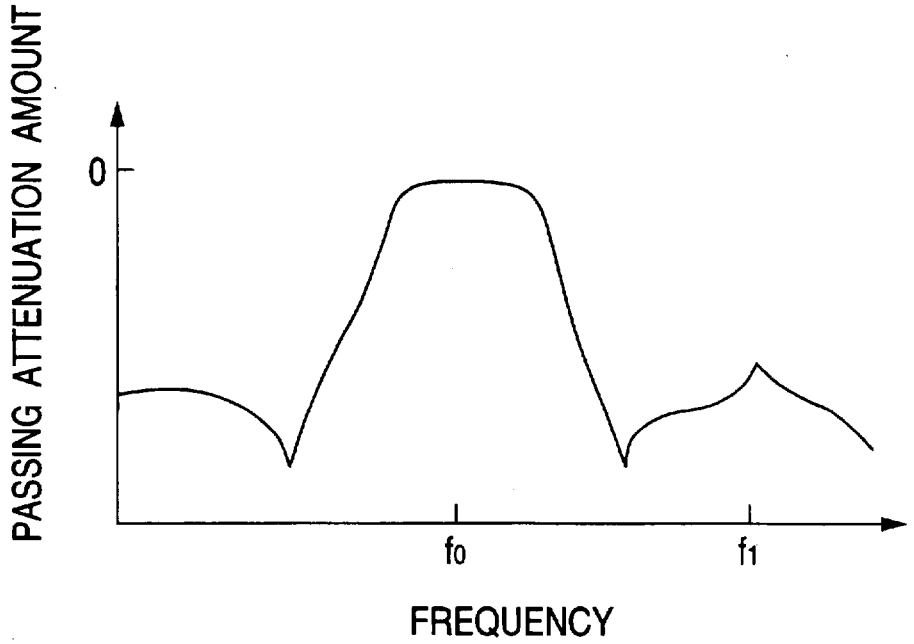
FIG. 2 is a graph showing the passing characteristic of a high frequency filter according to the first embodiment of the present invention.

FIG. 1 is a block diagram of a high frequency filter according to the first embodiment of the invention, and FIG. 2 is a graph showing the passing amplitude characteristic of the high frequency filter.

In FIG. 1, reference numerals 1*a*–1*d* denote first resonators for defining the number of stages of the filter, respectively; 2 one of capacitive coupling means serving as main coupling means for coupling the adjacent first resonators 1 with each other; 3 a second resonator; 4 one of capacitive coupling means serving as jumping coupling means for coupling the first resonators and the second resonator with each other; 5 one of capacitive coupling means serving as an input/output coupling means; and P1 and P2 input/output terminals, respectively.

As seen from FIG. 1, the first resonators 1*a*–1*d* are connected in series through the capacitive coupling means 2. The first resonators 1*a* and 1*d* located at both ends of the series connection are connected to the terminals P1 and P2 through the capacitive coupling means 5. The second resonator 3 is connected to both first resonators 1*a* and 1*d* through the capacitive coupling means. The first resonators 1*a* and 1*d* are weakly coupled with each other through the second resonator 3.

The capacitive coupling means 2, 4 and 5 may be realized by capacitors and the like. The concrete configuration of the first resonators 1 and second resonator 3 will be described later.

An explanation will be given of the operation of the high frequency filter according to the first embodiment. Now assuming that the four first resonators 1*a* to 1*d* resonate at the same frequency f0, the four resonators in a resonance state at the frequency f0 are strongly capacitive-coupled with one another. Thus, the incident wave to the terminal P1 is guided through the resonators 1*a* to 1*c* to the resonator 1*d* and taken out from the terminal P2.

On the other hand, at the frequency other than f0, the resonators 1*a* to 1*d* are very weakly coupled with one another, most of the electric power of the incident wave to the input/output terminal is reflected. In this way, the high frequency filter shown in FIG. 1 serves as a band-pass filter.

In the high frequency filter shown in FIG. 1, the first resonators 1*a* and 1*d* at both ends are coupled by the main coupling through the intermediate first resonators 1*b* and 1*c* and also jumping-coupled through the second resonator 3 and the capacitive coupling means 4.

As in the prior art, the passing phase of the resonator is +90° at the frequency lower than the resonance frequency, 0° at the frequency and −90° at the frequency higher than the resonance frequency. In this case, the passing phase of the second resonator 3 has approximately the above constant values at the frequency in the vicinity of the resonance frequency irrespectively of the connecting position of the capacitive coupling means 4. The passing phase of the capacitive coupling means in the series connection is +90° whereas that of the inductive coupling means in the series connection is −90°. The main coupling between the resonators 1*a* and 1*d* located at both ends, which passes through two resonators and three stages of capacitive coupling means, has a total passing phase of 450° (=90°) at the frequency lower than f0 and of +90° at the frequency higher than f0.

On the other hand, in the jumping-coupling, when the resonance frequency f1 of the second resonator 3 is set at the frequency higher than f0, the passing phase of the second resonator 3 is +270° (=−90°) at the frequency of f<f0, and is −90° also at the frequency of f0<f<f1.

Thus, in the high frequency filter according to the first embodiment shown in FIG. 1, at the set frequency f<f0, the passing phase by the main coupling and that by the jumping-coupling are opposite in both frequency ranges lower and higher than f0. This gives rise to attenuation poles in the passing characteristic in both higher and lower frequency ranges than the passing band, thus making the attenuation characteristic abrupt. In this case, the jumping coupling, the amount of which is very little, has little effect on the loss of the passing band.

As described above, in the high frequency filter shown in FIG. 1, the capacitive coupling means 4 located at two positions for jumping-coupling are connected by the second resonator 3. For this reason, even if the first resonators 1*a* and 1*d* are apart from each other approximately by the physical size of the resonator 3, a desired passing phase can be realized with no phase shift providing the frequency characteristic by the connecting line.

Where the resonators and the jumping coupling means in a filter are formed on the same dielectric plate, or otherwise the permittivity of the dielectric material constituting the filter is relatively small, desired attenuation poles in the passing characteristic can be produced.

(Embodiment 2)

Figure 3:
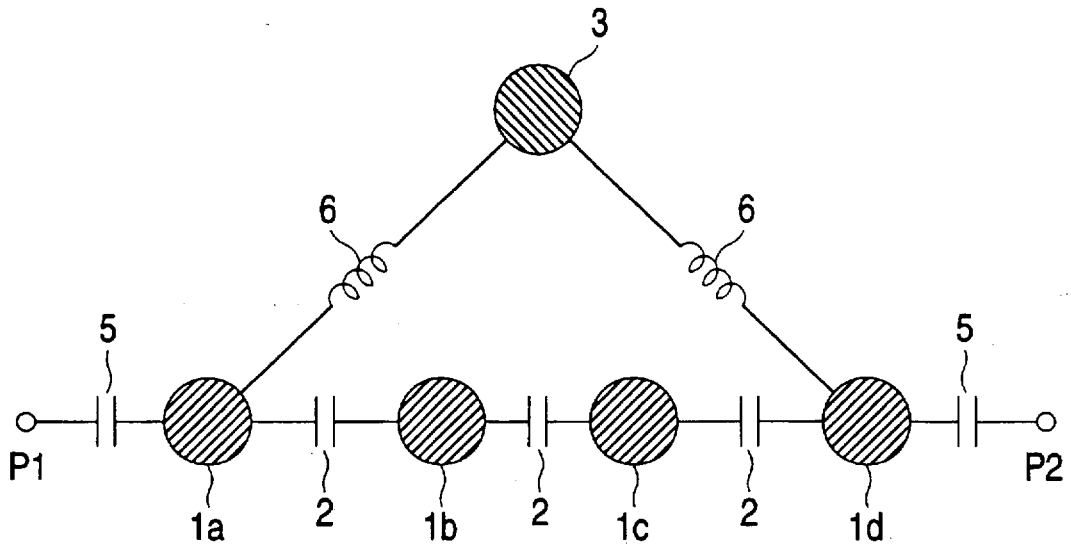
FIG. 3 is a schematic diagram of a high frequency filter according to the second embodiment of the present invention.
Figure 4:
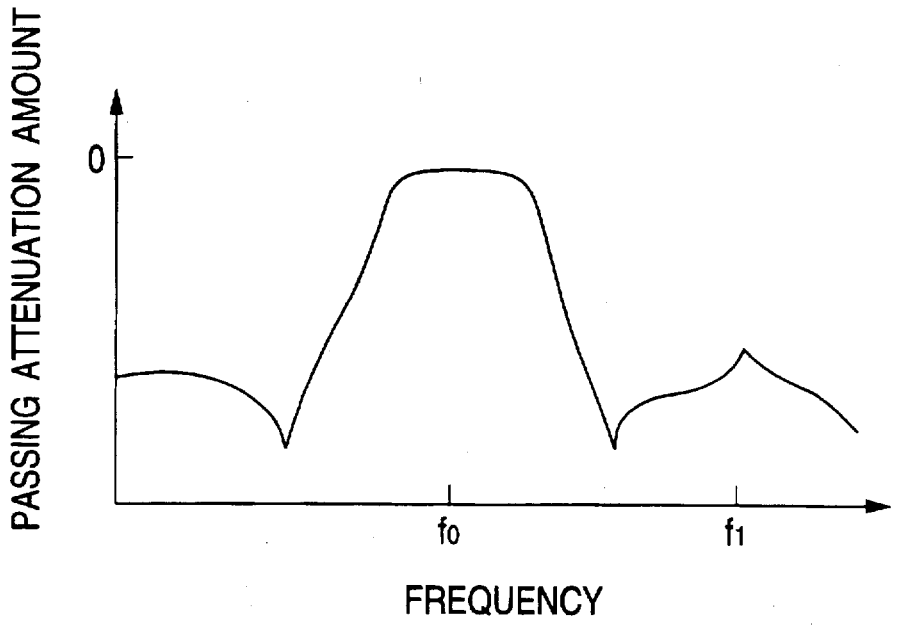
FIG. 4 is a graph showing the passing characteristic of a high frequency filter according to the second embodiment of the present invention.

FIG. 3 is a block diagram of a high frequency filter according to the second embodiment of the invention, and FIG. 4 is a graph showing the passing amplitude characteristic of the high frequency filter.

As seen from FIG. 3, in the high frequency filter according to this embodiment, inductive coupling means 6 are provided in place of the capacitive coupling means 4 in FIG. 1.

In this embodiment also, the first resonators 1*a* and 1*d* located at both ends are coupled by the main coupling through the intermediate first resonators 1*b* and 1*c* and also jumping-coupled through the second resonator 3 and the inductive coupling means 6. The main coupling between the resonators 1*a* and 1*d* located at both ends, which passes through two resonators and three stages of capacitive coupling means, has a total passing phase of 450° (=90°) at the frequency lower than f0 and of +90° at the frequency higher than f0.

In the jumping-coupling also, when the resonance frequency f1 of the second resonator 3 is set at the frequency higher than f0, the passing phase of the second resonator 3 is −90°) at the frequency of f<f0, and is −90° also at the frequency of f0<f<f1.

Thus, in the high frequency filter according to the second embodiment shown in FIG. 3, at the set frequency f1<f0, the passing phase by the main coupling and that by the jumping-coupling are opposite in both frequency ranges lower and higher than f0. This gives rise to attenuation poles in the passing characteristic in both higher and lower frequency ranges than the passing band, thus making the attenuation characteristic abrupt. In this case, the jumping coupling, the amount of which is very little, has little effect on the loss of the passing band.

As described above, in the high frequency filter shown in FIG. 3, the inductive coupling means 6 located at two positions for jumping-coupling are connected by the second resonator 3. For this reason, even if the first resonators 1*a* and 1*d* are apart from each other approximately by the physical size of the resonator 3, a desired passing phase can be realized, thus providing the same advantage as that of the first embodiment.

(Embodiment 3)

Figure 5:
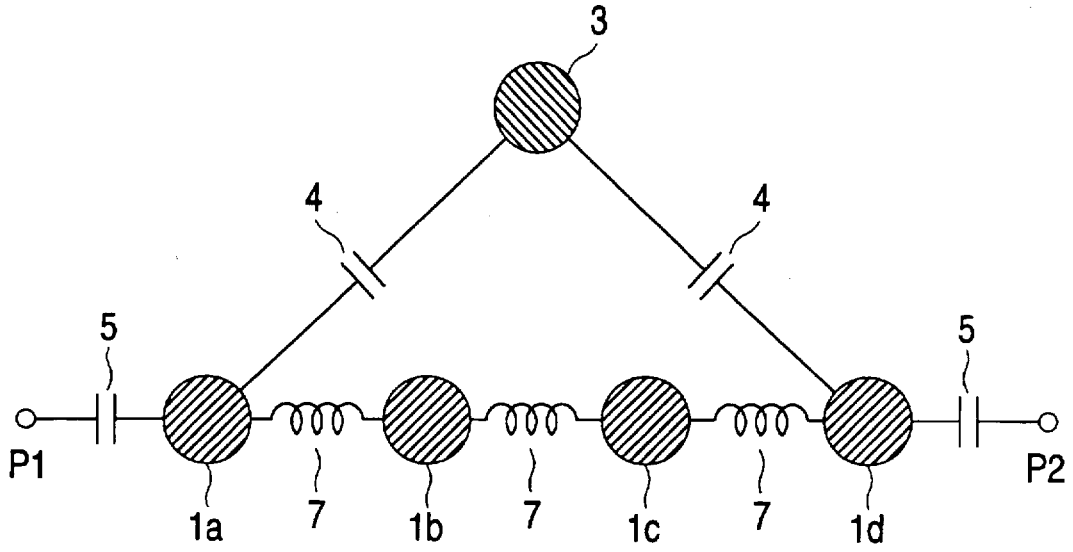
FIG. 5 is a schematic diagram of a high frequency filter according to the third embodiment of the present invention.
Figure 6:
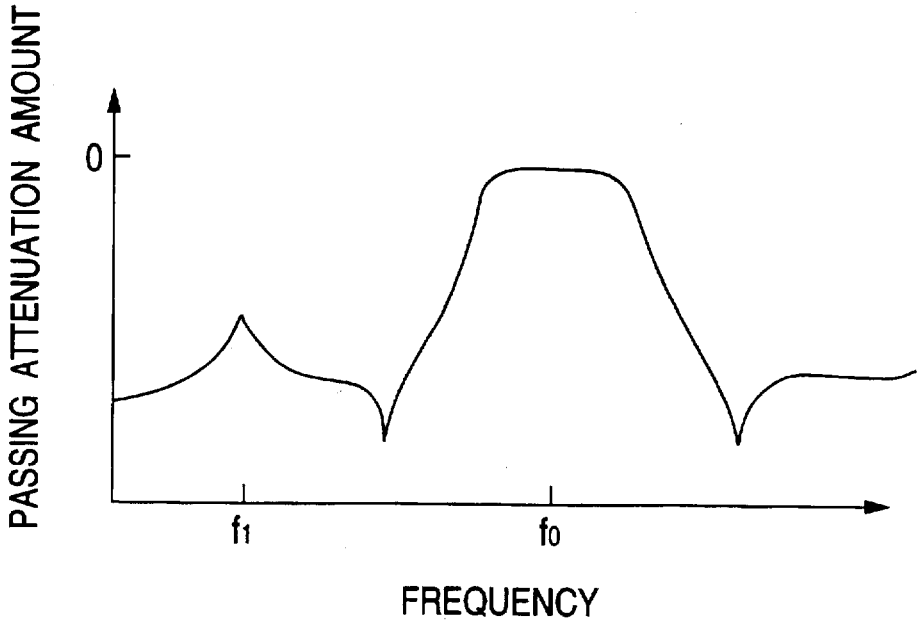
FIG. 6 is a graph showing the passing characteristic of a high frequency filter according to the third embodiment of the present invention.

FIG. 5 is a block diagram of a high frequency filter according to the third embodiment of the invention, and FIG. 6 is a graph showing the passing amplitude characteristic of the high frequency filter.

As seen from FIG. 5, in the high frequency filter according to the third embodiment, inductive coupling means 7 are provided in place of the capacitive coupling means in FIG. 1.

In this case, the first resonators 1*a* and 1*d* located at both ends are coupled by the main coupling through the intermediate first resonators 1*b* and 1*c* and the inductive coupling means 7 located at three positions, and also jumping-coupled through the second resonator 3 and the capacitive coupling means 4.

The main coupling between the resonators 1*a* and 1*d* located at both ends, which passes through two resonators and three stages of inductive coupling means, has a total passing phase of −90° at the frequency lower than f0 and of −450° (=−90°) at the frequency higher than f0.

When the resonance frequency f1 of the second resonator 3 is set at the frequency lower than f0, the total passing phase in the jumping coupling is +90° in the frequency f of the second resonator 3 of f1<f<f0 and also +90° at f0<f.

Thus, in the high frequency filter according to the third embodiment shown in FIG. 5, at the set frequency f1<f0, the passing phase by the main coupling and that by the jumping-coupling are opposite in both frequency ranges lower and higher than f0. This gives rise to attenuation poles in the passing characteristic in both higher and lower frequency ranges than the passing band, thus making the attenuation characteristic abrupt. In this case, the jumping coupling, the amount of which is very little, has little effect on the loss of the passing band.

As described above, in the high frequency filter shown in FIG. 5, the capacitive coupling means 4 located at two positions for jumping-coupling are connected by the second resonator 3. For this reason, even if the first resonators 1*a* and 1*d* are apart from each other approximately by the physical size of the resonator 3, a desired passing phase can be realized, thus providing the same advantage as that of the first embodiment.

(Embodiment 4)

Figure 7:
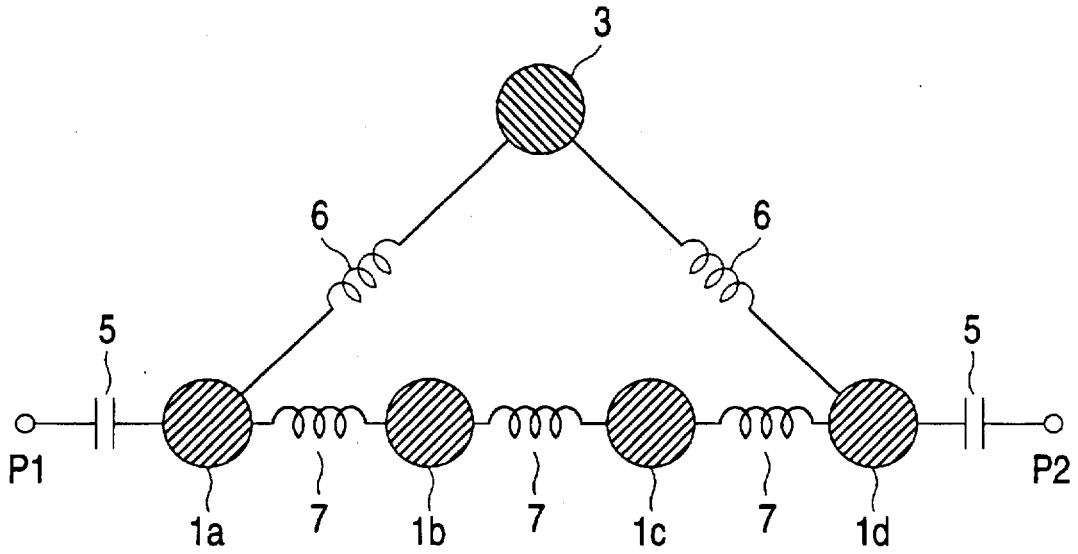
FIG. 7 is a schematic diagram of a high frequency filter according to the fourth embodiment of the present invention.
Figure 8:
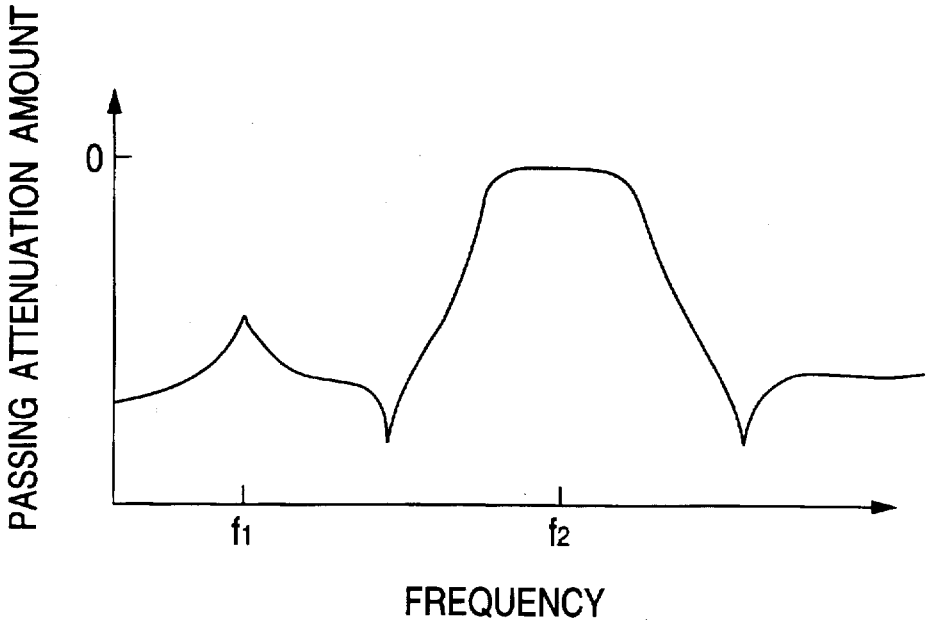
FIG. 8 is a graph showing the passing characteristic of a high frequency filter according to the fourth embodiment of the present invention.

FIG. 7 is a block diagram of a high frequency filter according to the fourth embodiment of the invention, and FIG. 8 is a graph showing the passing amplitude characteristic of the high frequency filter.

As seen from FIG. 7, in the high frequency filter according to the fourth embodiment, inductive coupling means 6 are provided in place of the capacitive coupling means 4 in FIG. 5.

In this case also, the first resonators 1*a* and 1*d* located at both ends are coupled by the main coupling through the intermediate first resonators 1*b* and 1*c* and the inductive coupling means 7 located at three positions, and also jumping-coupled through the second resonator 3 and the inductive coupling means 6.

The main coupling between the resonators 1*a* and 1*d* located at both ends, which passes through two resonators and three stages of inductive coupling means, has a total passing phase of −90° at the frequency lower than f0 and of −450° (=−90°) at the frequency higher than f0.

When the resonance frequency f1 of the second resonator 3 is set at the frequency lower than f0, the total passing phase in the jumping coupling is −270° (=+90°) in the frequency f of the second resonator 3 of f1<f<f0 and also +90° at f0<f.

Thus, in the high frequency filter according to the fourth embodiment shown in FIG. 7, at the set frequency f1<f0, the passing phase by the main coupling and that by the jumping-coupling are opposite in both frequency ranges lower and higher than f0. As shown in FIG. 8, this gives rise to attenuation poles in the passing characteristic in both higher and lower frequency ranges than the passing band, thus making the attenuation characteristic abrupt. In this case, the jumping coupling, the amount of which is very little, has little effect on the loss of the passing band.

As described above, in the high frequency filter shown in FIG. 7, the capacitive coupling means 4 located at two positions for jumping-coupling are connected by the second resonator 3. For this reason, even if the first resonators 1*a* and 1*d* are apart from each other approximately by the physical size of the resonator 3, a desired passing phase can be realized, thus providing the same advantage as that of the first embodiment.

(Embodiment 5)

Figure 9:
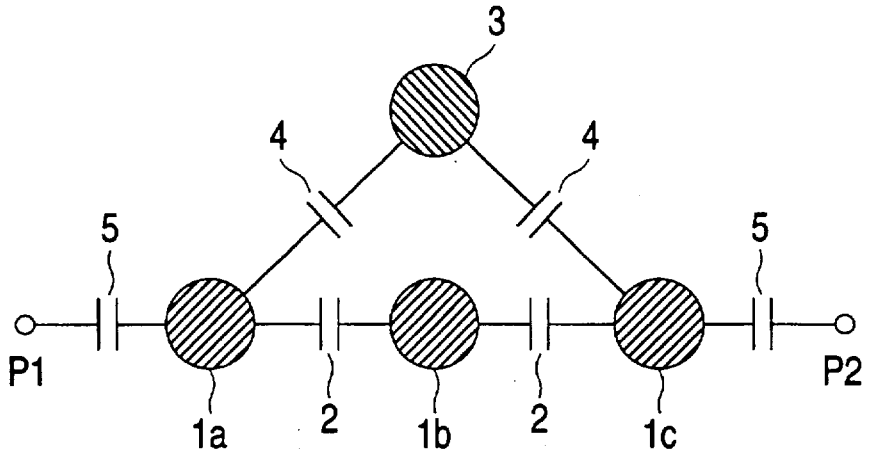
FIG. 9 is a schematic diagram of a high frequency filter according to the fifth embodiment of the present invention.
Figure 10:
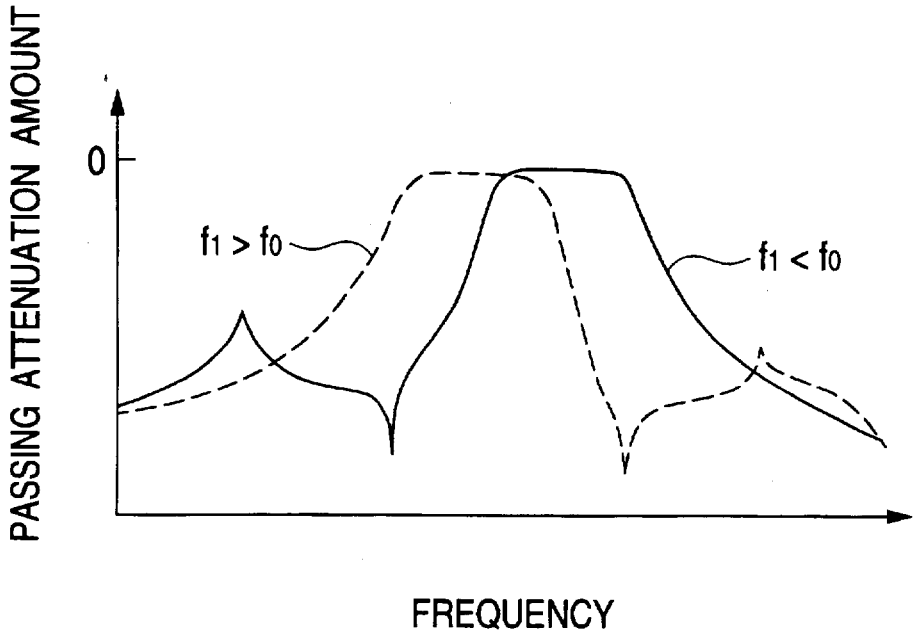
FIG. 10 is a graph showing the passing characteristic of a high frequency filter according to the fifth embodiment of the present invention.

FIG. 9 is a block diagram of a high frequency filter according to the fifth embodiment of the invention, and FIG. 10 is a graph showing the passing amplitude characteristic of the high frequency filter.

As seen from FIG. 9, in the high frequency filter according to the fifth embodiment, three first resonators 1*a* to 1*c*, unlike the four first resonators in FIG. 1, are provided.

In this case also, the first resonators 1*a* and 1*c* located at both ends are coupled by the main coupling through the intermediate first resonator 1*b* and the capacitive coupling means 2 located at two positions, and also jumping-coupled through the second resonator 3 and the capacitive-coupling means 4. The main coupling between the resonators 1*a* and 1*c* on both ends, which passes through one resonator and two stages of inductive coupling means, has a total passing phase of +270° (=−90°) at the frequency lower than f0 and of +90° at the frequency higher than f0.

When the resonance frequency f1 of the second resonator 3 is set at the frequency lower than f0, the total passing phase in the jumping coupling is +90° in the frequency f of the second resonator 3 of f1<f<f0, and also +90° at f0<f.

On the other hand, when the resonance frequency f1 of the second resonator 3 is set at the frequency higher than f0, the total passing phase in the jumping coupling is +270° (=−90°) in the frequency f of the second resonator 3 of f<f0, and also −90° at f0<f<f1.

Thus, in the high frequency filter according to the fifth embodiment shown in FIG. 9, at the set frequency f1<f0, the passing phase by the main coupling and that by the jumping-coupling are opposite in the frequency range lower than f0, whereas at the set frequency f1>f0, they are opposite in the frequency range higher than f0. The passing characteristic in both cases are shown in FIG. 10. In this case, the jumping coupling, the amount of which is very little, has little effect on the loss of the passing band.

As described above, in the high frequency filter shown in FIG. 9, the capacitive coupling means 4 located at two positions for jumping-coupling are connected by the second resonator 3. For this reason, even if the first resonators 1*a* and 1*c* are apart from each other approximately by the physical size of the resonator 3, a desired passing phase can be realized, thus providing the same advantage as that of the first embodiment. Further, in accordance with the set resonance frequency f1 of the second resonator, the attenuation pole can be provided on only the one side of the passing band.

(Embodiment 6)

Figure 11:
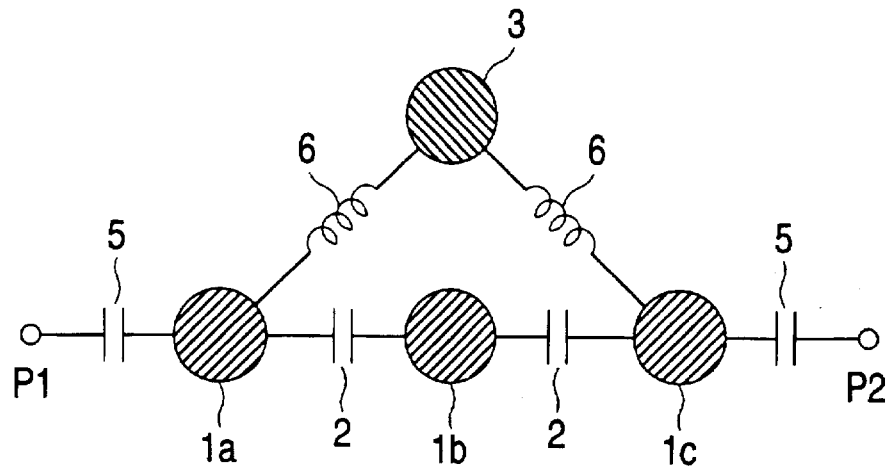
FIG. 11 is a schematic diagram of a high frequency filter according to the sixth embodiment of the present invention.
Figure 12:
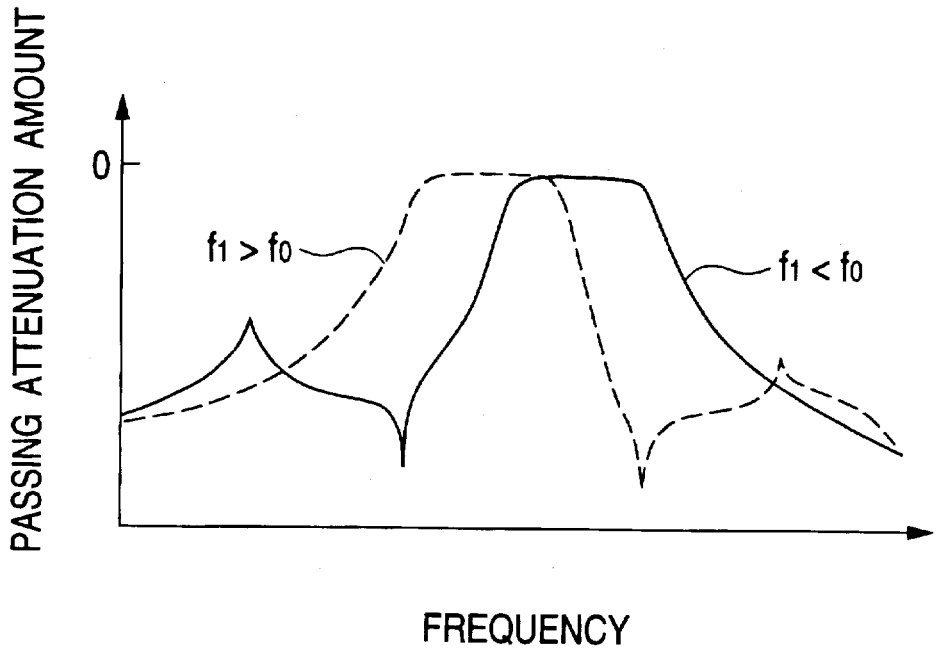
FIG. 12 is a graph showing the passing characteristic of a high frequency filter according to the sixth embodiment of the present invention.

FIG. 11 is a block diagram of a high frequency filter according to the sixth embodiment of the invention, and FIG. 12 is a graph showing the passing amplitude characteristic of the high frequency filter.

As seen from FIG. 11, in the high frequency filter according to the sixth embodiment, inductive coupling means 6 are provided in place of the capacitive coupling means in FIG. 9.

In this case also, the first resonators 1*a* and 1*c* located at both ends are coupled by the main coupling through the intermediate first resonator 1*b* and the inductive coupling means 2 located at two positions, and also jumping-coupled through the second resonator 3 and the inductive coupling means 6. The main coupling between the resonators 1*a* and 1*c* located at both ends, which passes through one resonator and two stages of capacitive coupling means as in the case of FIG. 9, has a total passing phase of +270° (=−90°) at the frequency lower than f0 and of +90° at the frequency higher than f0.

When the resonance frequency f1 of the second resonator 3 is set at the frequency lower than f0, the total passing phase in the jumping coupling is −270° (=+90°) in the frequency f of the second resonator 3 of f1<f<f0, and also +90° at f0<f.

On the other hand, when the resonance frequency f1 of the second resonator 3 is set at the frequency higher than f0, the total passing phase in the jumping coupling is −90° in the frequency f of the second resonator 3 of f<f0, and also −90° at f0<f<f1.

Thus, in the high frequency filter according to the sixth embodiment shown in FIG. 11, at the set frequency f1<f0, the passing phase by the main coupling and that by the jumping-coupling are opposite in the frequency range lower than f0, whereas at the set frequency f1>f0, they are opposite in the frequency range higher than f0. The passing characteristic in both cases are shown in FIG. 12. In this case, the jumping coupling, the amount of which is very little, has little effect on the loss of the passing band.

As described above, in the high frequency filter shown in FIG. 9, the capacitive coupling means 6 located at two positions for jumping-coupling are connected by the second resonator 3. For this reason, even if the first resonators 1*a* and 1*c* are apart from each other approximately by the physical size of the resonator 3, a desired passing phase can be realized, thus providing the same advantage as that of the first embodiment. Further, in accordance with the set resonance frequency f1 of the second resonator, the attenuation pole can be provided on only the one side of the passing band.

(Embodiment 7)

Figure 13:
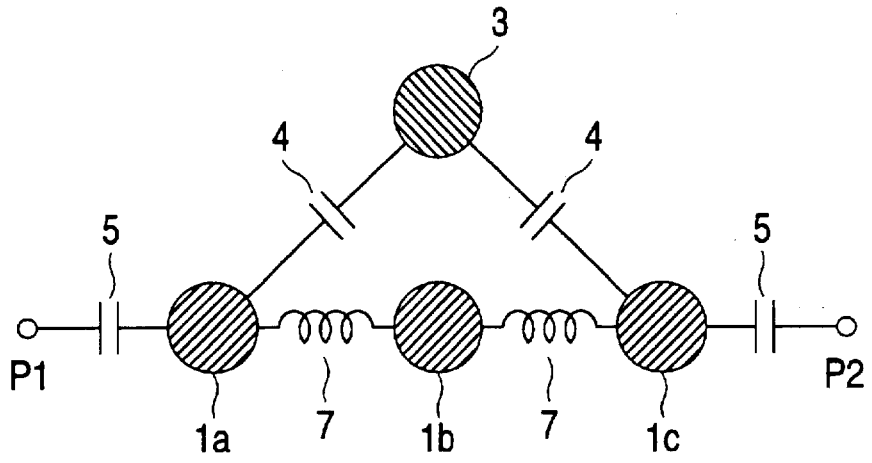
FIG. 13 is schematic diagram of a high frequency filter accord the seventh embodiment of the present invention.

FIG. 13 is a block diagram of a high frequency filter according to the seventh embodiment of the invention, and FIG. 12 is a graph showing the passing amplitude characteristic of the high frequency filter.

As seen from FIG. 13, in the high frequency filter according to the seventh embodiment, inductive coupling means 7 are provided in place of the capacitive coupling means 2 in FIG. 9.

In this case also, the first resonators 1*a* and 1*c* on both ends are coupled by the main coupling through the intermediate first resonator 1*b* and the inductive coupling means 7 located at two positions, and also jumping-coupled through the second resonator 3 and the inductive coupling means 4. The main coupling between the resonators 1*a* and 1*c* located at both ends, which passes through one resonator and two stages of inductance coupling means, has a total passing phase of −90° at the frequency lower than f0 and of −270° (=+90°) at the frequency higher than f0.

When the resonance frequency f1 of the second resonator 3 is set at the frequency lower than f0, the total passing phase in the jumping coupling is +90° in the frequency f of the second resonator 3 of f1<f<f0, and also +90° at f0<f. On the other hand, when the resonance frequency f1 of the second resonator 3 is set at the frequency higher than f0, the total passing phase in the jumping coupling is +270° (=−90°) in the frequency f of the second resonator 3 of f<f0, and also −90° at f0<f<f1.

Figure 14:
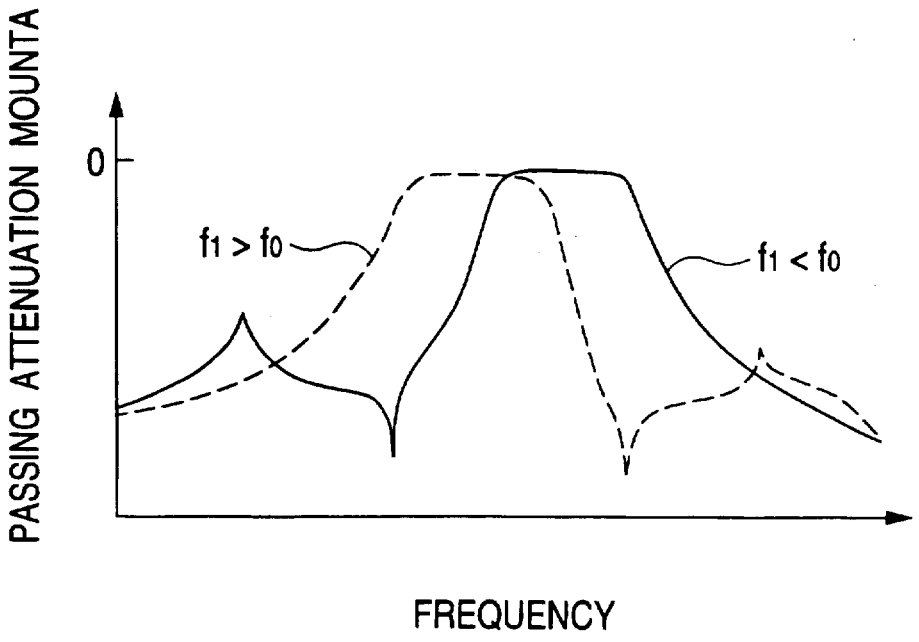
FIG. 14 is a graph showing the passing characteristic of a high frequency filter according to the seventh embodiment of the present invention.

Thus, in the high frequency filter according to the seventh embodiment shown in FIG. 13, at the set frequency f1<f0, the passing phase by the main coupling and that by the jumping-coupling are opposite in the frequency range lower than f0, whereas at the set frequency f1>f0, they are opposite in the frequency range higher than f0. The passing characteristic in both cases are shown in FIG. 14. In this case, the jumping coupling, the amount of which is very little, has little effect on the loss of the passing band.

As described above, in the high frequency filter shown in FIG. 13, the capacitive coupling means 4 located at two positions for jumping-coupling are connected by the second resonator 3. For this reason, even if the first resonators 1*a* and 1*c* are apart from each other approximately by the physical size of the resonator 3, a desired passing phase can be realized, thus providing the same advantage as that of the first embodiment. Further, in accordance with the set resonance frequency f1 of the second resonator, the attenuation pole can be provided on only the one side of the passing band.

(Embodiment 8)

Figure 15:
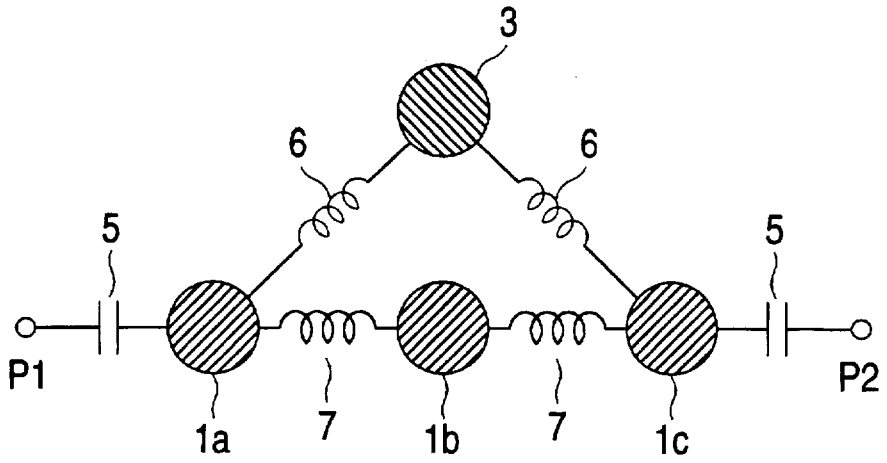
FIG. 15 is a schematic diagram of a high frequency filter according to the eighth embodiment of the present invention.
Figure 16:
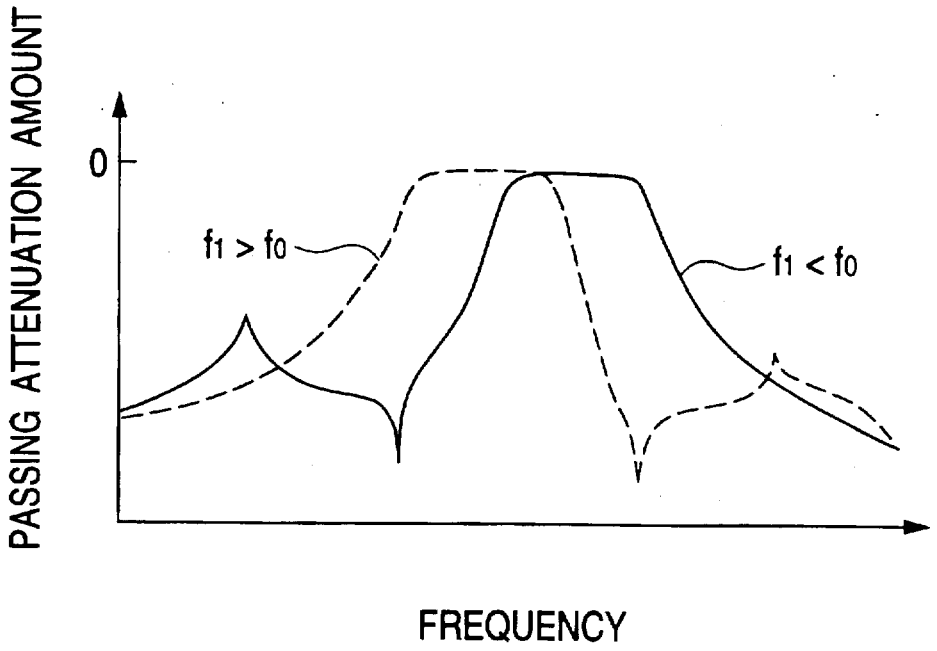
FIG. 16 is a graph showing the passing characteristic of a high frequency filter according to the eighth embodiment of the present invention.

FIG. 15 is a block diagram of a high frequency filter according to the eighth embodiment of the invention, and FIG. 16 is a graph showing the passing amplitude characteristic of the high frequency filter.

As seen from FIG. 15, in the high frequency filter according to the eighth embodiment, inductive coupling means 6 are provided in place of the capacitive coupling means 4 in FIG. 13.

In this case also, the first resonators 1*a* and 1*c* located at both ends are coupled by the main coupling through the intermediate first resonator 1*b* and the inductive coupling means 7 located at two positions, and also jumping-coupled through the second resonator 3 and the inductive coupling means 6. The main coupling between the resonators 1*a* and 1*c* located at both ends, which passes through one resonator and two stages of inductance coupling means, has a total passing phase of −90° at the frequency lower than f0 and of −270° (=+90°) at the frequency higher than f0.

When the resonance frequency f1 of the second resonator 3 is set at the frequency lower than f0, the total passing phase in the jumping coupling is −270° (=+90°) in the frequency f of the second resonator 3 of f1<f<f0, and also +90° at f0<f. On the other hand, when the resonance frequency f1 of the second resonator 3 is set at the frequency higher than f0, the total passing phase in the jumping coupling is −90° in the frequency f of the second resonator 3 of f<f0, and also −90° at f0<f<f1.

Thus, in the high frequency filter according to the eighth embodiment shown in FIG. 15, at the set frequency f1<f0, the passing phase by the main coupling and that by the jumping-coupling are opposite in the frequency range lower than f0, whereas at the set frequency f1>f0, they are opposite in the frequency range higher than f0. The passing characteristic in both cases are shown in FIG. 16. In this case, the jumping coupling, the amount of which is very little, has little effect on the loss of the passing band.

As described above, in the high frequency filter shown in FIG. 15, the inductive coupling means 6 located at two positions for jumping-coupling are connected by the second resonator 3. For this reason, even if the first resonators 1*a* and 1*c* are apart from each other approximately by the physical size of the resonator 3, a desired passing phase can be realized, thus providing the same advantage as that of the first embodiment. Further, in accordance with the set resonance frequency f1 of the second resonator, the attenuation pole can be provided on only the one side of the passing band.

(Embodiment 9)

Figure 17:
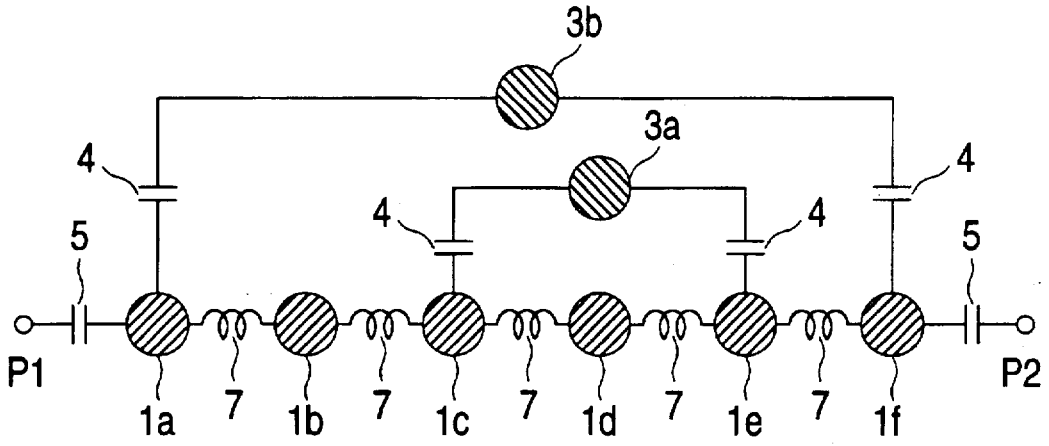
FIG. 17 is a schematic diagram of a high frequency filter according to the ninth embodiment of the present invention.
Figure 18:
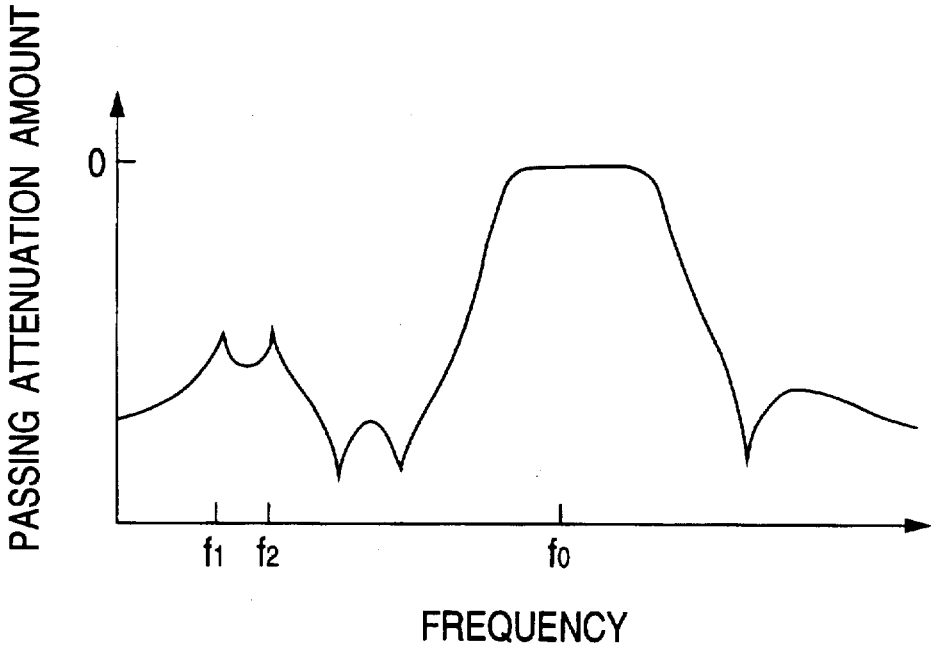
FIG. 18 is a graph showing the passing characteristic of a high frequency filter according to the ninth embodiment of the present invention.

FIG. 17 is a block diagram of a high frequency filter according to the ninth embodiment of the invention, and FIG. 18 is a graph showing the passing amplitude characteristic of the high frequency filter.

As seen from FIG. 17, in the high frequency filter according to the ninth embodiment, six first resonators 1*a* to 1*f* which are the first resonators in FIG. 13 are provided, and jumping coupling is made between the intermediate resonators 1*c* and 1*e* and between the end resonators 1*a* and 1*f*.

The advantage by the jumping-coupling between the resonators 1*c* and 1*e* is the same as that in the embodiment of FIG. 13. Namely, at a set frequency f1<f0, the passing phase by the main coupling and that by the jumping-coupling are opposite in the frequency range lower than f0, whereas at the set frequency f1>f0, they are opposite in the frequency range higher than f0.

On the other hand, the main coupling between the resonators 1*a* and 1*f* located at both ends, which passes through four resonators and five stages of inductance coupling means, has a total passing phase of −90° at the frequency lower than f0 and of −810° (=−90°) at the frequency higher than f0.

When the resonance frequency f2 of the second resonator 3*b* is set at the frequency lower than f0, the total passing phase in the jumping coupling is +90° in the frequency f of the second resonator 3*b* of f2<f<f0, and also +90° at f0 <f.

On the other hand, when the resonance frequency f2 of the second resonator 3*b* is set at the frequency higher than f0, the total passing phase in the jumping coupling is +270° (=−90°) in the frequency f of the second resonator 3*b* of f<f0, and also −90° at f0<f<f2.

Thus, at the set frequency f2<f0, the passing phase by the main coupling and that by the jumping-coupling are opposite in both frequency ranges lower and higher than f0. As seen from FIG. 18, this gives rise to attenuation poles in the passing characteristic in both higher and lower frequency ranges than the passing band. In this case, the jumping coupling, the amount of which is very little, has little effect on the loss of the passing band.

As described above, the ninth embodiment shown in FIG. 17 has the same advantage as those in FIGS. 1 to 16 and also permits the attenuation poles on the one side to be made deeper or two attenuation poles to be provided by adjustment of the relationship between f1 and f0.

(Embodiment 10)

Figure 19:
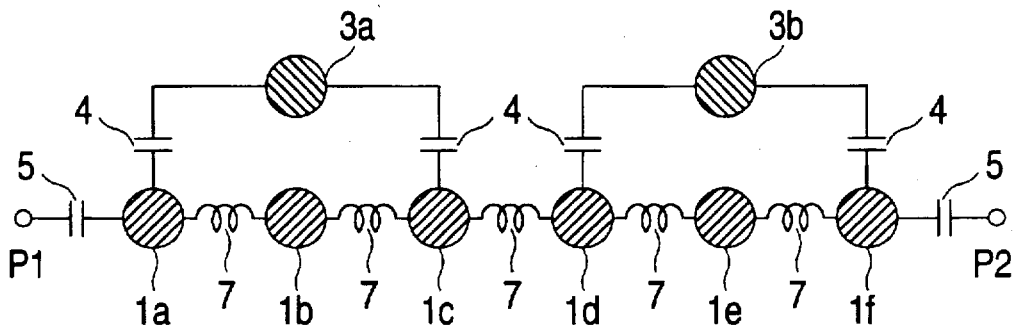
FIG. 19 is a schematic diagram of a high frequency filter according to the tenth embodiment of the present invention.
Figure 20:
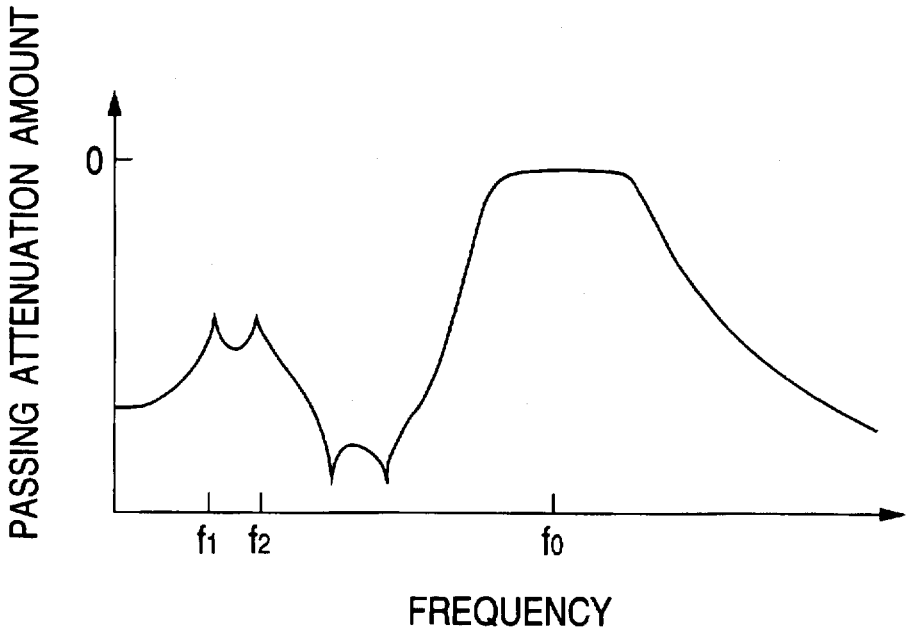
FIG. 20 is a graph showing the passing characteristic of a high frequency filter according to the tenth embodiment of the present invention.

FIG. 19 is a block diagram of a high frequency filter according to the tenth embodiment of the invention, and FIG. 20 is a graph showing the passing amplitude characteristic of the high frequency filter.

As seen from FIG. 19, in the high frequency filter according to the tenth embodiment, six first resonators 1*a* to 1*f* which are the first resonators in FIG. 13 are provided, and two stages of jumping-coupling through the second resonator 3 (3*a* and 3*b* ) and the inductive coupling means are provided.

In this case also, as shown in FIG. 20, in accordance with the relationship between the resonance frequencies f1 and f2 of the second resonators 3*a* and 3*b* and the resonance frequency f0 of the first resonators, an attenuation pole(s) of the passing characteristic may be produced in the frequency range higher or lower than the passing band or both ranges thereof. In this case, the jumping coupling, the amount of which is very little, has little effect on the loss of the passing band.

As described above, the tenth embodiment shown in FIG. 19 has the same advantage as those in FIGS. 1 to 16 and also permits plural attenuation poles on the one or both sides of the passing band to be provided by adjustment of the relationship between f1 and f2, and f0.

In the embodiments of the present invention shown in FIGS. 1 to 20, three, four or six resonators defining the number of stages of the filter were provided. But two, five or seven or more resonators may be provided to define the number of stages of the filter, which can provide the same operation theory, advantage and effect as the embodiments described above.

(Embodiment 11)

Figure 21:
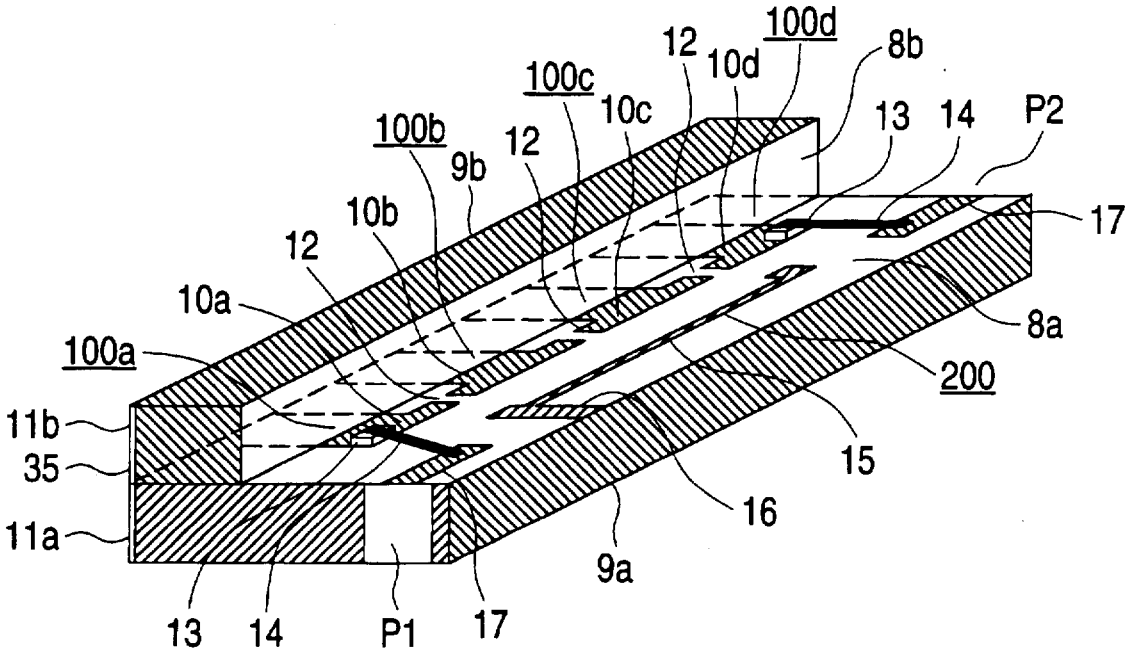
FIG. 21 is a schematic diagram of a high frequency filter according to the eleventh embodiment of the present invention.
Figure 22:
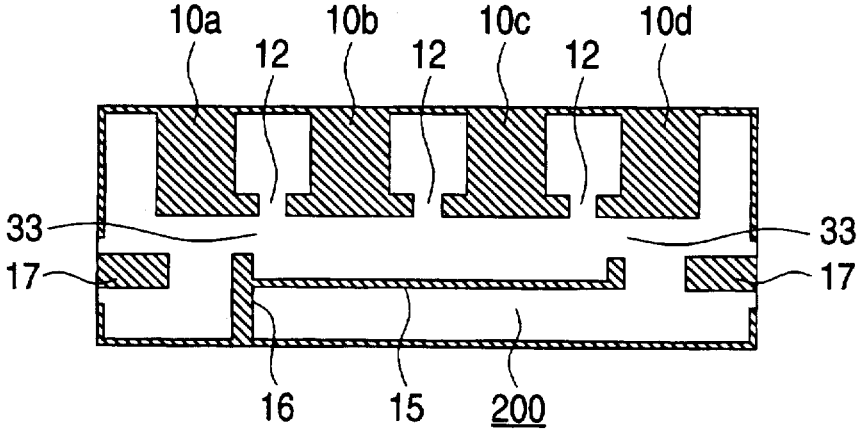
FIG. 22 is a view showing the conductor pattern of a high frequency filter according to the eleventh embodiment of the present invention.

FIG. 21 is a perspective view of the eleventh embodiment of the present invention. FIG. 22 is a view showing the strip conductor of a high frequency filter.

In FIGS. 21 and 22, reference numerals 8*a* and 8*b* denote dielectric plates, respectively. As seen from FIG. 21, the dielectric plates 8*a* and 8*b* have substantially equal lengths and thicknesses, but the dielectric plate 8*a* has a larger width than that of the dielectric plate 8*b*. The dielectric plate 8*b* is overlaid on the dielectric plate 8*a*.

Reference numeral 9*a* denotes an outer conductor of an conductive film formed in intimate contact with the one entire surface of the dielectric plate 8*a*. Reference numeral 9*a* denotes an outer conductor of an conductive film formed in intimate contact with the one entire surface of the dielectric plate 8*a*.

Reference numerals 10*a* to 10*d* denote strip conductors each of a conductive film formed in intimate contact with the other surface of the dielectric plate 8*a*. These strip conductors are arranged substantially in parallel as seen from the pattern shown in FIG. 22.

Reference numeral 11*a* denotes a short-circuiting area of a conductive film formed in intimate contact with the one side of the dielectric plate 8*a* and connected to the outer conductor 9*a* and the inner conductors 10*a* to 10*d*. Reference numeral 11*b* denotes a short-circuiting area of a conductive film formed in intimate contact with the one side of the dielectric plate 8*b* and connected to the outer conductor 9*b*.

Reference numeral 12 denotes one of gaps for increasing the width of the open area of each of the strip conductors 10*a* to 10*d* and locally reducing the interval between the adjacent strip conductors and serving as a capacitive coupling means.

Reference numeral 13 denotes one of capacitors formed at the tips of the inner conductors 10*a* and 10*d*, respectively.

Reference numeral 14 denotes one of conductor ribbons for connecting the capacitors 13 to input/output lines 17 described later, respectively.

Reference numeral 15 denotes a strip conductor having a length of an approximately ¼ wavelength made of a conductive film in intimate contact with the other surface of the dielectric plate 8*a* and arranged in the vicinity of the open ends of the strip conductors 10*a* to 10*d* to cross them.

Reference numeral 16 denotes a short-circuiting conductor formed in intimate contact with this surface of the dielectric plate 8*a* and extending from the one end of the strip conductor 15 to the side wall of the dielectric plate 8*a*. The short-circuiting conductor 16 is connected to the outer conductor 9*a* through a conductive film.

Reference numeral 17 denotes an input/output line. Reference numerals P1 and P2 denotes input/output terminals, respectively.

Reference numeral 33 denotes a gap formed between the strip conductors 10*a* and 10*d* and serving as a capacitive coupling means.

The dielectric plates 8*a*, 8*b*, outer conductors 9*a*, 9*b*, strip conductors 10*a* to 10*d*, and short-circuiting areas 11*a*, 11*b* constitute resonators 100*a* to 100*d*. These resonators 100*a* to 100*d* correspond to the first resonators 1*a* to 1*d* in FIG. 1 and others.

The dielectric plate 8*a*, outer conductor 9*a*, strip conductor 15 and short-circuiting conductor 16 constitute a resonator 200. This resonator 200 corresponds to the resonator 3 in FIG. 1 and others.

The dielectric plates 8*a* and 8*b* are stacked in intimate contact with each other so that those reverse to the surfaces where the outer conductors 9*a* and 9*b* are formed face each other and the short-circuiting areas 11*a* and 11*b* are arranged in intimate contact with each other in the same plane. In order to strengthen the electric contact between the short-circuiting areas 11*a* and 11*b* and the mechanical contact between the dielectric plates 8*a* and 8*b*, a further short-circuiting plate 35 is kept in contact with the outside of the short-circuiting areas 11*a* and 11*b* by cream soldering.

At the area of the dielectric plate 8*b* facing the strip conductors 10*a* to 10*d*, the dielectric plate 8*b* has strip conductors having substantially the same shape as that of the strip conductors 10*a* to 10*d*, in intimate contact therewith and their one end connected to the short-circuiting area 11*b*.

The one end of the strip conductors is short-circuited with the outer conductors 9*a* and 9*b* by the short-circuiting areas 11*a*, 11*b* and short-circuit plate 35 whereas the other end thereof constitutes open ends. Thus, the resonators 100*a* to 100*d* serve as a ¼ wavelength resonator with the one end short-circuited and the other end opened.

With respect to the strip conductor 15, since its length is set for approximately ¼ wavelength and its one end is short-circuited with the outer conductor 9*a* through the short-circuiting conductor, the resonator 200 also serves as a ¼ wavelength resonator.

An explanation will be given of the operation of the high frequency filter shown in FIG. 21. Now assuming that four resonators 100*a* to 100*d* resonate at the same frequency f0, the four resonators in a resonance state at the frequency f0 are very strongly capacitively coupled with each other through the gaps 12. The incident wave to the terminal P1 is guided to the resonator 100*d* through the resonators 100*a* to 100*c* and taken out from the terminal P2. On the other hand, at the frequency other than f0, the coupling among the resonators 100*a* to 100*d* and most of the electric power of the incident wave to the input/output terminal is reflected. In this way, the high frequency filter according to the embodiment of FIG. 21 serves as a band-pass filter.

Further, in the high frequency filter shown in FIG. 21, the resonators 100*a* and 100*d* on both ends are coupled by the main coupling through the intermediate resonators 100*b* and 100*c* and also jumping-coupled through the resonator 200 and the gaps 33 each serving as capacitive coupling means.

Then, as in the case of the second resonator 3 shown in FIG. 1, the passing phase of the resonator 200 is +90° at the frequency lower than the resonance frequency and −90° at the frequency higher than the resonance frequency, and hence approximately the above constant values at the frequency in the vicinity of the resonance frequency irrespectively of the position of the gaps 33. Thus, as in the high frequency filter according to the first embodiment shown in FIG. 1, when the resonance frequency f1 of the resonator 200 is set for f0<f1, the passing phase by the main coupling and that by the jumping-coupling are opposite in both frequency ranges lower and higher than f0. This gives rise to attenuation poles in the passing characteristic in both higher and lower frequency ranges than the passing band, thus making the attenuation characteristic abrupt. In this case, the jumping coupling, the amount of which is very little, has little effect on the loss of the passing band.

As described above, in the high frequency filter shown in FIG. 21, even if the resonators 100*a* and 100*d* are apart from each other approximately by the length of the strip line 15 set for approximately a ¼ wavelength, a jumping-coupling having a desired passing phase can be realized by the resonator 200 formed in the same plane as the resonators 100*a* to 100*d* and the gaps 33. Therefore, where the resonators and the jumping coupling means in a filter are formed on the same dielectric plate, desired attenuation poles in the passing characteristic can be formed.

(Embodiment 12)

Figure 23:
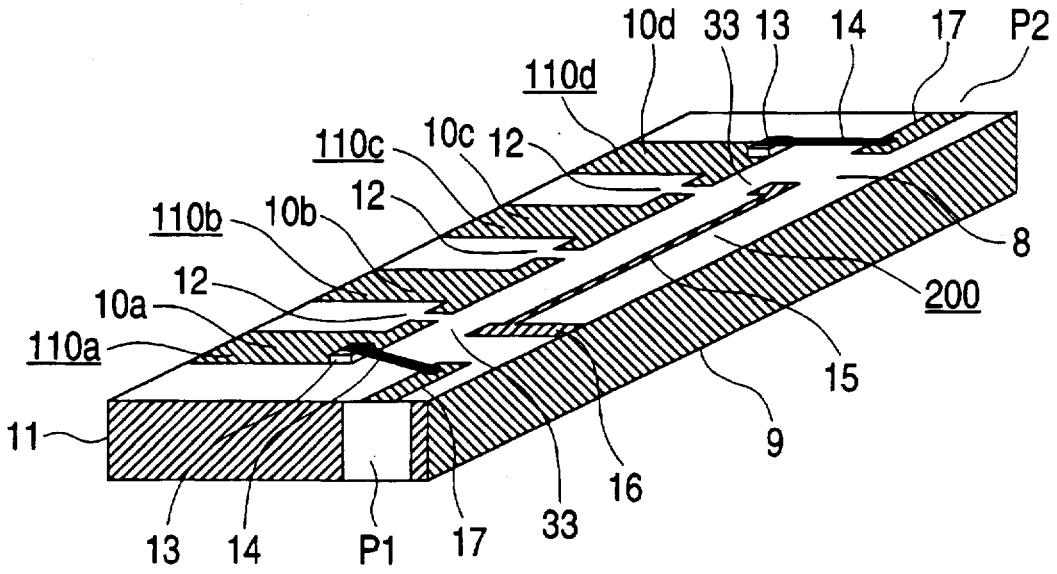
FIG. 23 is a schematic diagram of a high frequency filter according to the twelfth embodiment of the present invention.

FIG. 23 is a perspective view of a high frequency filter according to the twelfth embodiment of the present invention. The high frequency filter shown in FIG. 23 uses resonators 110*a*–110*d* having a microstrip line structure instead of the resonators 100*a* to 100*d* having a tri-plate structure according to the embodiment shown in FIG. 21.

The embodiment shown in FIG. 23 operates in the same operating theory as the embodiment shown in FIG. 21 operates, and has the same advantage as that of the latter. Further, this embodiment, in which the entire strip conductors 10*a* to 10*d* are exposed, can easily adjust the resonance frequency and amount of coupling the resonators by changing the length and width of each resonator.

(Embodiment 13)

Figure 24:
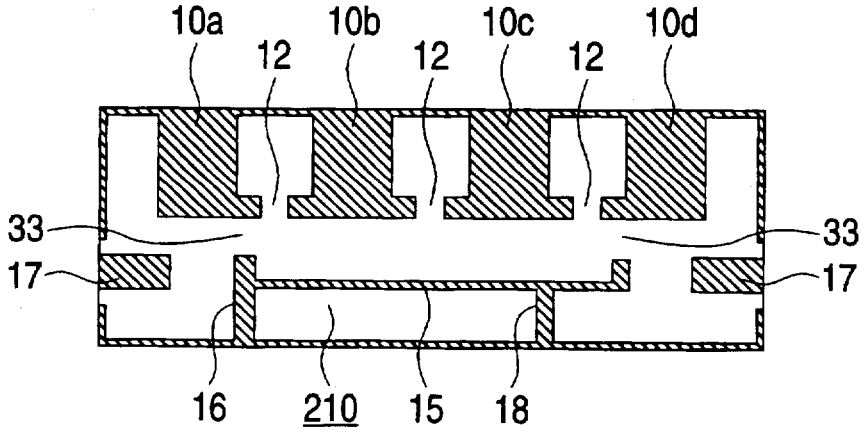
FIG. 24 is a graph showing the conductor pattern of a high frequency filter according to the thirteenth embodiment of the present invention.

FIG. 24 is a conductor pattern view of the high frequency filter according to the thirteenth embodiment of the present invention. The high frequency filter, in which the strip conductor 15 in the eleventh embodiment of FIG. 22 is provided with a tip-short-circuited stub 18 branching from its intermediate portion so that the tip is short-circuited with the outer conductor 9*a*, uses the resonator 210 consisting of the dielectric plate 8*a*, outer conductor 9*a*, strip conductor 15, short-circuiting conductor 16 and the tip-circuited stub 18 instead of the resonator 200 serving as a jumping-coupling resonator.

The embodiment shown in FIG. 24 operates in the same operating theory as the embodiment shown in FIG. 21 operates, and has the same advantage as that of the latter. Further, this embodiment can easily change the resonance frequency of the resonator 210 by moving the connecting position of the tip-short-circuited stub 18, thereby easily changing the frequency forming an attenuation pole.

(Embodiment 14)

Figure 25:
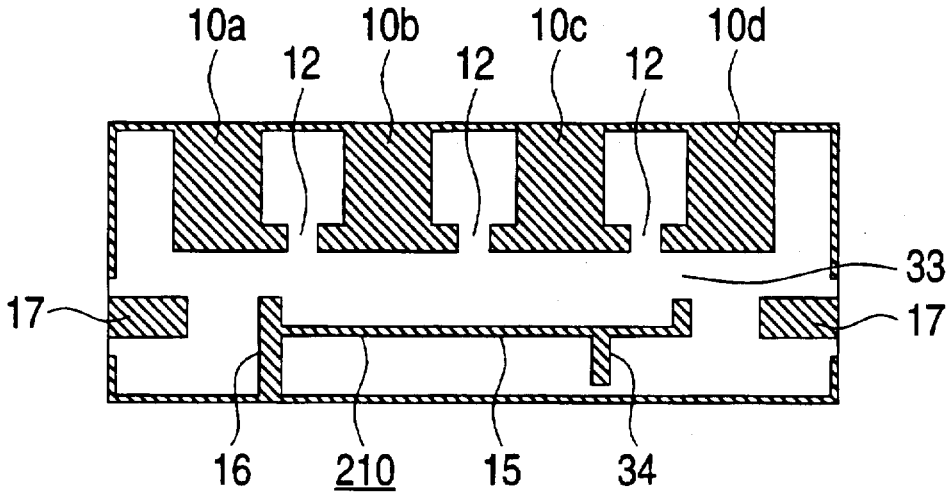
FIG. 25 is a schematic diagram of a high frequency filter accord to the fourteenth embodiment of the present invention.

FIG. 25 is a conductor pattern view of the high frequency filter according to the fourteenth embodiment of the present invention. The high frequency filter, in which a tip-opened stub 34 is provided instead of the tip-short-circuited stub 18 in the thirteenth embodiment of the invention shown in FIG. 24, uses the resonator 210 consisting of the dielectric plate 8*a*, outer conductor 9*a*, strip conductor 15, short-circuiting conductor 16 and the tip-opened stub 34 instead of the resonator 210 serving as a jumping-coupling resonator.

The embodiment shown in FIG. 25 operates in the same operating theory as the embodiment shown in FIG. 24 operates, and has the same advantage as that of the latter. Further, this embodiment, since the tip-opened stub 84 includes no short-circuiting stub 34, can be more easily fabricated than the filter provided with the tip-short-circuited stub.

Figure 26:
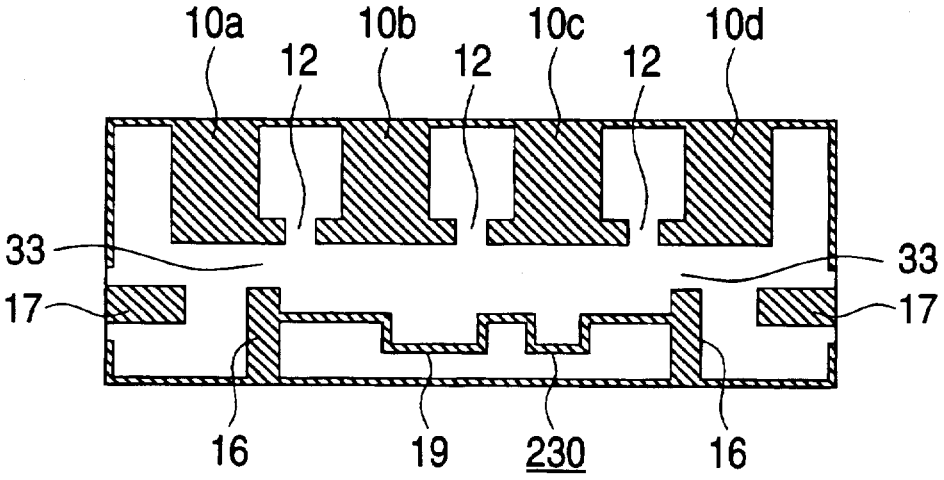
FIG. 26 is a graph showing the conductor pattern of a high frequency filter according to the fifteenth embodiment of the present invention.

FIG. 26 is a conductor pattern view of the high frequency filter according to the fifteenth embodiment of the present invention. The high frequency filter uses, instead of the resonator 200 for jumping-coupling in the eleventh embodiment of FIG. 22, the resonator 230 consisting of the dielectric plate 8*a*, outer conductor 9*a*, strip conductor 19 and short-circuiting conductor 16. The strip conductor 19 has a length of an approximately ½ wavelength and short-circuited at its both ends by short-circuiting conductors 16. Therefore, the resonator 220 serves as a ½ wavelength resonator with both ends short-circuited.

The embodiment shown in FIG. 26 operates in the same operating theory as the embodiment shown in FIG. 21 operates, and has the same advantage as that of the latter. Further, in the high frequency filter according to the embodiment in which the strip conductor 19 has a length of approximately ½ wavelength, even if the resonators 100*a* and 100*d* are apart from each other by approximately ½ wavelength, the filter can realize a desired passing phase as jumping coupling and attenuation poles in the passing characteristic.

(Embodiment 16)

Figure 27:
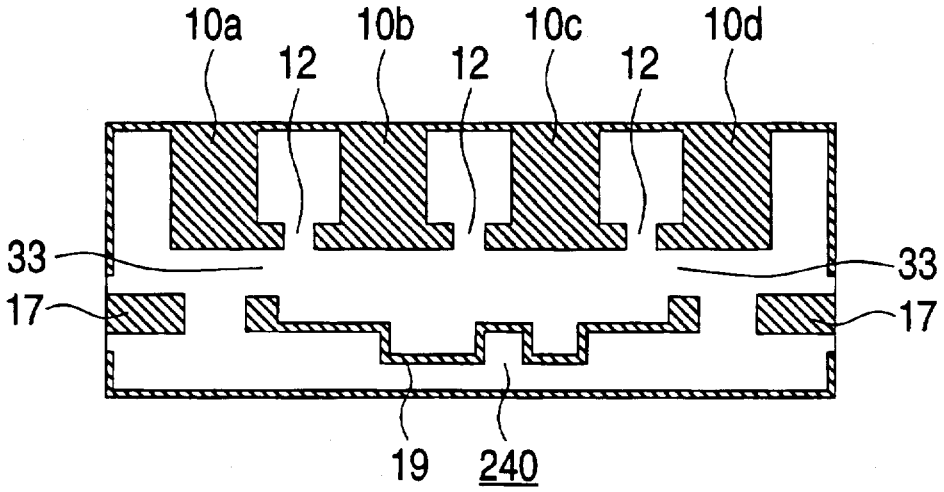
FIG. 27 is a schematic diagram of a high frequency filter according to the sixteenth embodiment of the present invention.

FIG. 27 is a conductor pattern viewed of the high frequency filter according to the sixteenth embodiment of the present invention. The high frequency filter uses, instead of the resonator 230 for jumping-coupling in the fifteenth embodiment of FIG. 26, the resonator 240 consisting of the dielectric plate 8*a*, outer conductor 9*a* and strip conductor 19. The resonator 220, in which both ends of the strip conductor are opened, serves as a ½ wavelength resonator with both ends short-circuited.

The embodiment shown in FIG. 26 operates in the same operating theory as the embodiment shown in FIG. 21 operates, and has the same advantage as that of the latter. Further, in the high frequency filter according to this embodiment, in which the short-circuiting conductors 16 are not required, can be easily fabricated.

(Embodiment 17)

Figure 28:
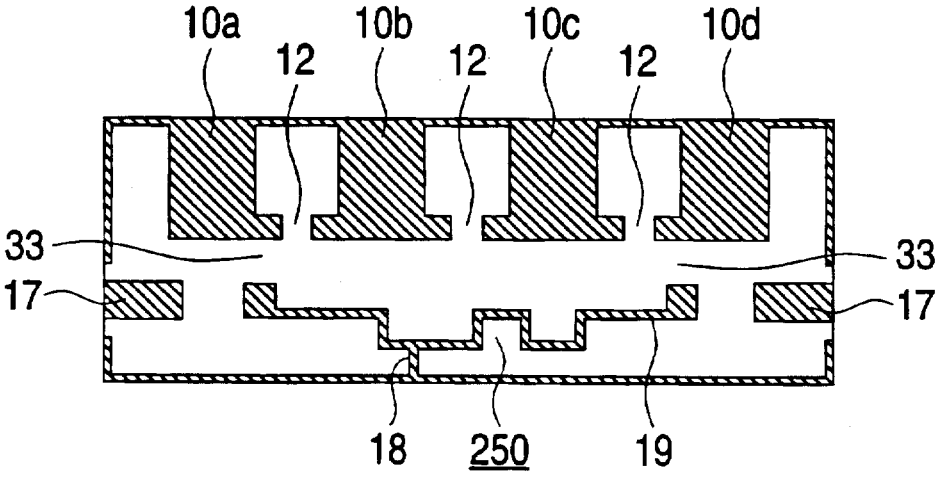
FIG. 28 is a graph showing the conductor pattern of a high frequency filter according to the seventeenth embodiment of the present invention.

FIG. 28 is a conductor pattern view of the high frequency filter according to the seventeenth embodiment of the present invention. The high frequency filter according to this embodiment, in which the strip conductor 19 in the sixteenth embodiment of FIG. 27 is provided with a tip-short-circuited stub 18 branching from its intermediate portion so that the tip is short-circuited with the outer conductor 9*a*, uses the resonator 250 consisting of the dielectric plate 8*a*, outer conductor 9*a*, strip conductor 19, short-circuiting conductor 16 and the tip-circuited stub 18 instead of the resonator 240 serving as a jumping-coupling resonator.

The embodiment shown in FIG. 28 operates in the same operating theory as the embodiment shown in FIG. 27 operates, and has the same advantage as that of the latter. Further, this embodiment can easily change the resonance frequency of the resonator 250 by moving the connecting position of the tip-short-circuited stub 18, thereby easily changing the frequency forming an attenuation pole.

(Embodiment 18)

Figure 29:
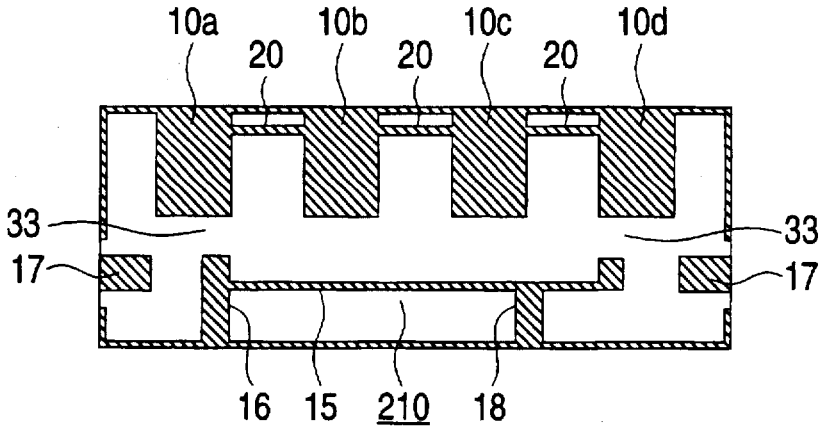
FIG. 29 is a schematic diagram of a high frequency filter accord the eighteenth embodiment of the present invention.

FIG. 29 is a conductor pattern view of the high frequency filter according to the eighteenth embodiment of the present invention. In this embodiment, in place of the gaps 12 serving as the capacitive coupling means among the resonators 100*a* to 100*d* in the embodiment shown in FIG. 24, connecting conductors 20 serving as inductive coupling means are provided.

The connecting conductors 20 which directly connects the strip conductors to each other to shunt a current. The main coupling between the resonators 10*a* and 10*d* with the connecting conductors 20 being sufficiently short, which passes through two resonators and three stages of inductive coupling means, has a total passing phase of −90° at the frequency lower than f0 and of −450° (=−90°) at the frequency higher than f0.

However, since the connecting conductors have a length equal to the interval between the resonators 10*a* to 10*d*, where there are a large number of connecting conductors, the phase shift due to the electric length of the connectors 20 themselves is not negligible. For example, when the total passing phase of the connecting conductors 20 is −180° at the frequency higher than f0, the total passing phase due to the main coupling between the resonators 100*a* and 100*d* in this frequency is +90°.

On the other hand, in the jumping-coupling also, when the resonance frequency f1 of the resonator 210 is set at f1>f0, the passing phase of the resonator is −90° at the frequency of f1 which is opposite to the passing phase by the main coupling. Thus, when the resonance frequency of the resonator 210 is f1>f0, and the frequency f providing the total passing phase of the connecting conductors 20 of −180° is within a range f0<f<f1, an attenuation pole at the frequency f is obtained.

The embodiment shown in FIG. 29 operates in the same operating theory as the embodiment shown in FIG. 21 operates, and has the same advantage as that of the latter. Further, where the total electric length of the connecting conductors 20 is −180 (2n−1)° (n=1, 2, . . . ) at the frequency in the vicinity of the passing band of the filter, provided that the resonance frequency of the resonator 210 is set to be higher than the resonance frequency of the resonators 100*a* to 100*d*, an attenuation pole in the passing characteristic can be obtained.

Figure 30:
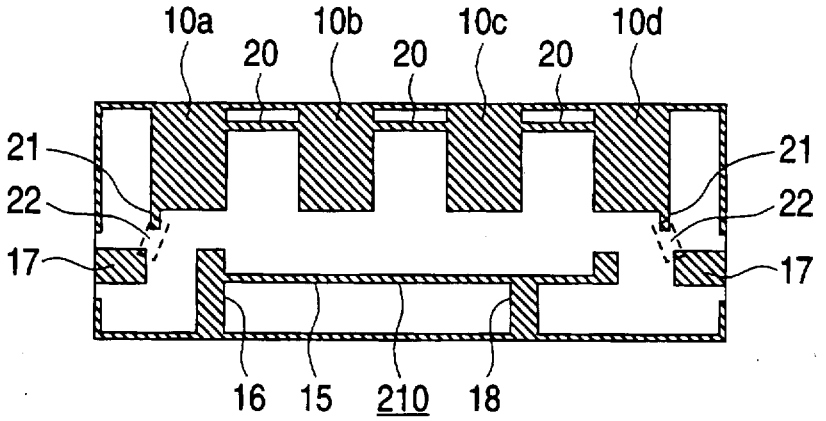
FIG. 30 is a graph showing the conductor pattern of a high frequency filter according to the nineteenth embodiment of the present invention.

FIG. 30 is a conductor pattern view of the high frequency filter according to the eighteenth embodiment of the present invention. In this embodiment, the open ends of the strip conductors 10*a* and 10*b* located at both ends in the embodiment shown in FIG. 29 are narrow protrusions 21, respectively which are made near to input/output lines 17. The conductor protrusion 21, which are formed by extending the strip conductors 10*a* and 10*d*, and have a sufficiently narrow width, have little effect on the resonance frequency of the resonators 100*a* to 100*d*.

Figure 31:
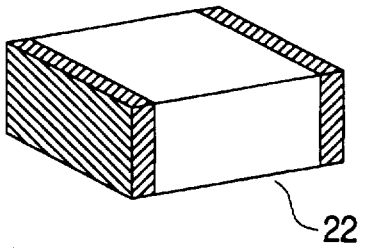
FIG. 31 is a schematic diagram of a high frequency filter according to the nineteenth embodiment of the present invention.

The embodiment shown in FIG. 30 operates in the same operating theory as the embodiment shown in FIG. 29 operates, and has the same advantage as that of the latter. Further, in the high frequency filter according to this embodiment, since the tips of the conductor protrusions 21 are near to the strip conductors of the input/output lines 17, the capacitors 22 as shown in FIG. 31 can be arranged at positions indicated in broken lines in FIG. 30 and their electrodes can be directly connected to the conductor protrusions 21 and the strip conductors of the input/output lines 17 by e.g. soldering, thereby making a conductor ribbon unnecessary.

(Embodiment 20)

Figure 32:
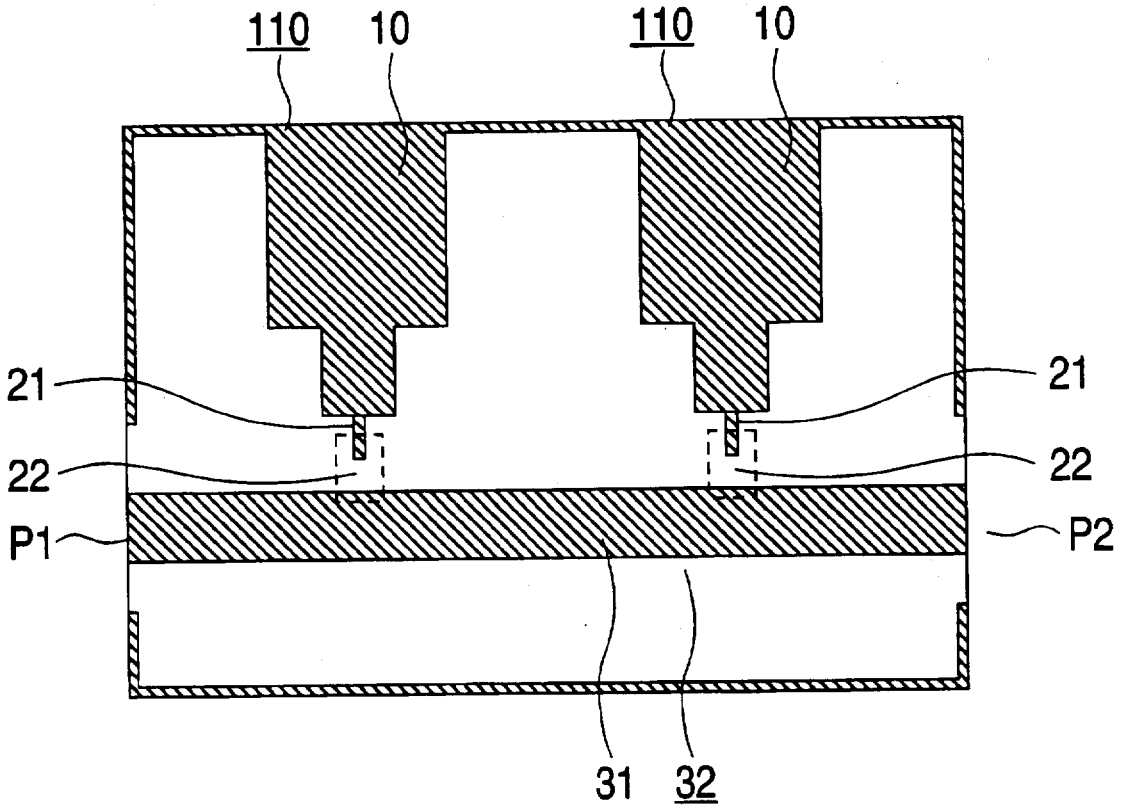
FIG. 32 is a graph showing the conductor pattern of a high frequency filter according to the twentieth embodiment of the present invention.
Figure 33:
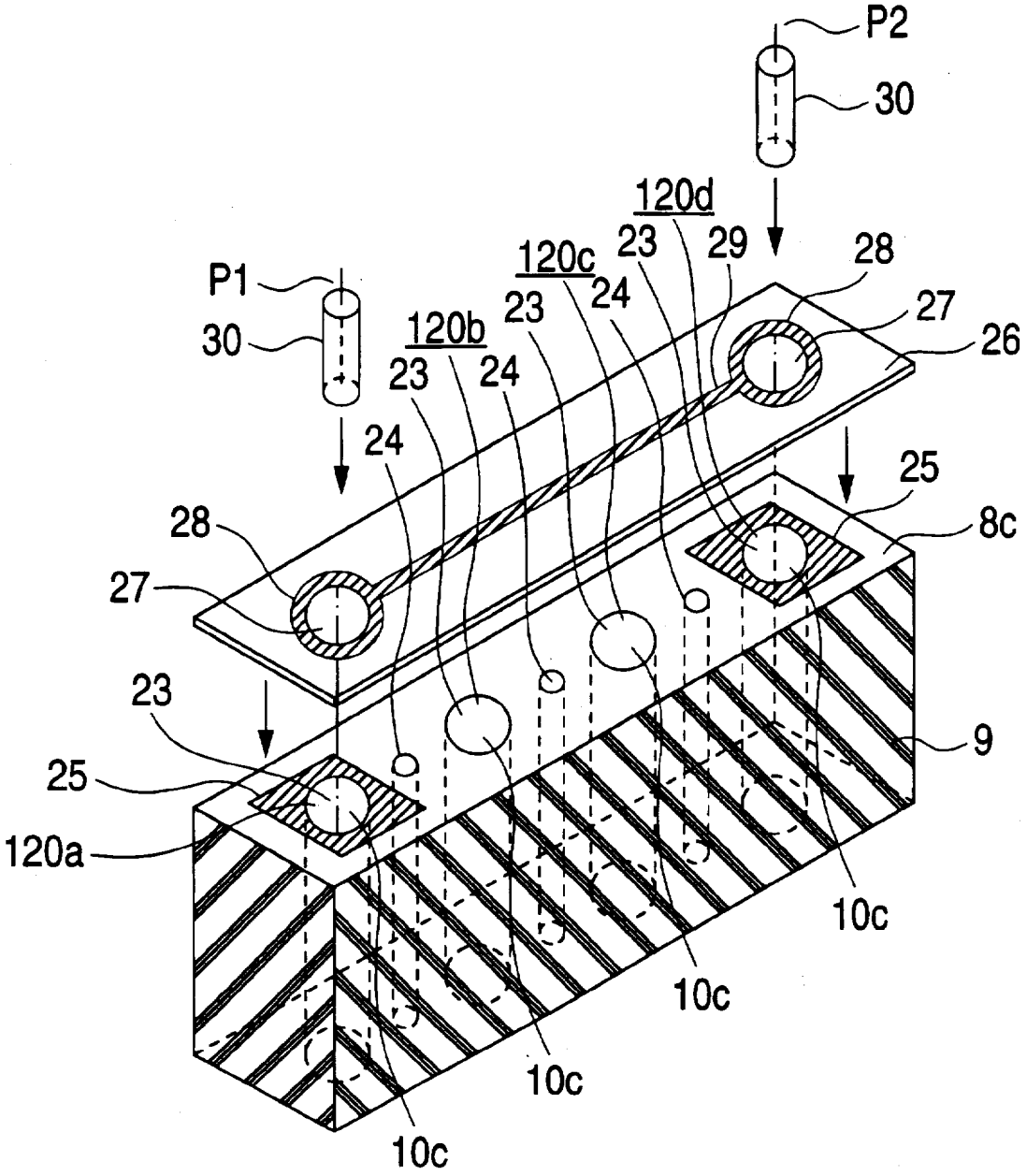
FIG. 33 is a schematic diagram showing a conventional high frequency filter.
Figure 34:
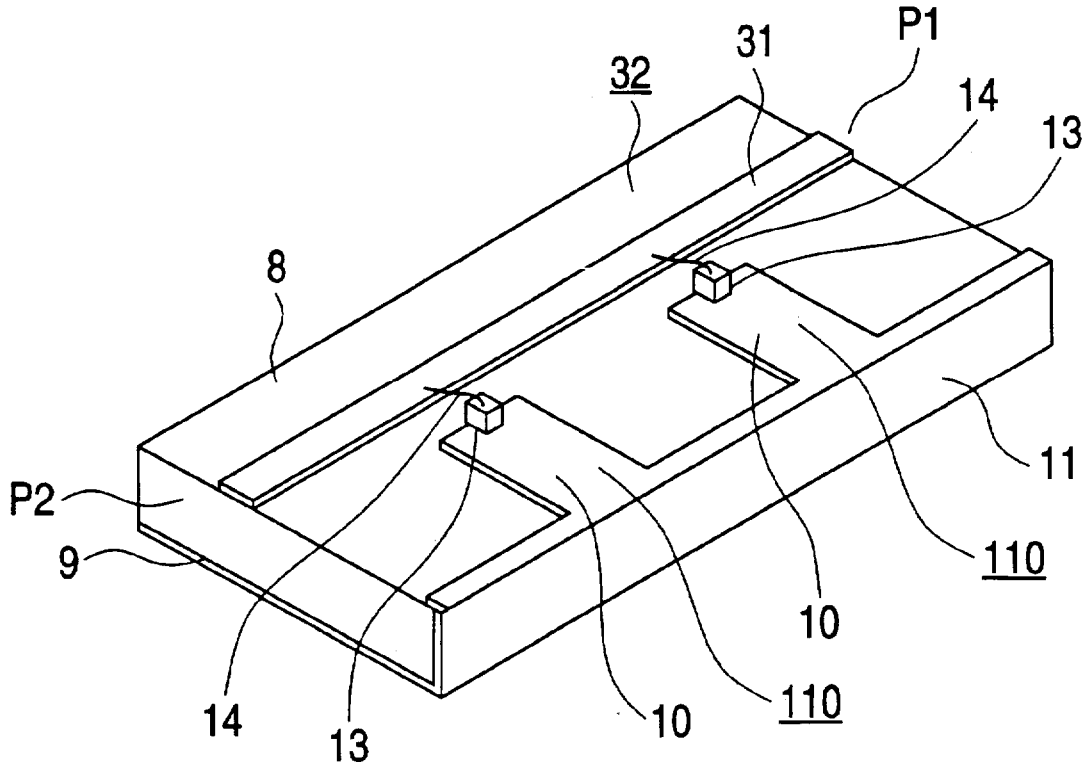
FIG. 34 is a schematic diagram showing a conventional high frequency filter.

FIG. 32 is a conductor pattern view of the high frequency filter according to the twentieth embodiment of the present invention. In FIG. 32, reference numerals 10, 31 and 32 correspond to those in the conventional high frequency filter shown in FIG. 34. Reference numeral 21 denote one of conductor protrusions shown in FIG. 34. The capacitors 22 can be arranged at positions indicated in broken lines in FIG. 32 and their electrodes can be directly connected to the conductor protrusions 21 and the strip conductors of the input/output lines 17 by e.g. soldering.

An explanation will be given of the operating theory. Each of the resonators 110, assuming that the resonance frequency is f, serves as an inductance at the frequency than f0 to constitute a series resonance circuit together with the capacitor 22. Now assuming that the series resonance frequency is f1, most of the electric power of the incident wave at the frequency of f1 to the terminal P1 is reflected. On the other hand, at the frequency other than f1, under little effect by the resonator, most of the incident wave to the terminal P1 is guided to the terminal P2. In this way, the high frequency filter shown in FIG. 32 serves as a band stop filter like the conventional high frequency filter.

In the embodiment shown in FIG. 32, since the width of the conductor protrusion 21 is narrow, with no production of its unnecessary coupling with the strip conductor 31, its tip can be made near to the strip conductor 31 of the strip conductor 32. For this reason, the electrodes of the capacitor 22 can be directly connected to the conductor protrusions 21 and the strip conductors of the input/output lines 17 by e.g. soldering, thereby making a conductor ribbon unnecessary.

As described above, the high frequency filter comprises an input terminal and an output terminal; a plurality of first resonators; a plurality of main coupling means for coupling said plurality of resonators with each other to be connected in series; a plurality of input/output coupling means for connecting both ends of said first resonators connected in series to said input terminal and said output terminal, respectively; a second resonator; and a plurality of jumping coupling means for coupling those located at both ends of said first resonators connected in series with said second resonator. In this configuration, the passing phases via the main connecting means and the jumping connection means are made opposite to each other at both frequency ranges lower and higher than the passing frequency band, thus making an attenuation pole in a passing characteristic of the attenuation area on one or both sides of a passing band.

The high frequency filter according to the present invention comprises a dielectric plate; an outer conductor formed on the one surface of said dielectric plate; a plurality of strip conductors formed on the other surface of said dielectric plate and arranged in substantially parallel to each other; a second strip conductor formed in a direction crossing said first strip conductors; and a first short-circuiting portion and a second short-circuiting portion for connecting the one end of said first strip conductors and the one end of said second strip conductor to said outer conductor, respectively, said each of the first resonators includes said dielectric plate, said outer conductor, said first strip conductors and said first short-circuit portion; and said second resonator includes said dielectric plate, said outer conductor, said second strip conductors and said second short-circuit portion.

In this configuration, even when the distance between the two resonators to be jumping connected is approximately equal to the length of the second resonator constructed by the second strip line, the difference between the passing phase by the main coupling and the jumping connection can be set for a desired value, thereby thus making an attenuation pole in a passing characteristic of the attenuation area on one or both sides of a passing band.

In the high frequency filter according to the present invention, said second strip conductor is provided with a tip-short-circuited stub branching from its intermediate portion and having a tip connected to said outer conductor to be short-circuited.

In this configuration, by varying the position or length of the tip-short-circuited stub, the resonance frequency of the second resonator can be varied, thus making the frequency of the attenuation pole variable.

In the high frequency filter according to the present invention, said second strip conductor is provided with a tip-opened stub branching from its intermediate portion and having an opened tip, by varying the position or length of the tip-short-circuited stub, the resonance frequency of the second resonator can be varied.

The high frequency filter according to the present invention comprises a first dielectric plate; a first outer conductor formed on the one surface of said first dielectric plate; a plurality of first strip conductors formed on the other surface of said first dielectric plate and arranged in substantially parallel to each other and having one ends connected to said first conductor to be short-circuited; a second dielectric plate; a second outer conductor formed on the one surface of said second dielectric plate; a plurality of second strip conductors formed on the other surface of said first dielectric plate and having substantially the same shape as that of each of said first strip conductors;

said first resonators are configured as a plurality of triplate line type resonators by stacking said first and second dielectric plates so that said first and said second strip conductors are opposite and overlay each other; and in order to short-circuit said strip conductors, a conductor foil or conductor plate is provided on the sides of said first and second dielectric plate.

Since said conductor foil or conductor plate is soldered using e.g. cream solder or plate solder, said first and said second dielectric plate can be mechanically connected to each other and the electric connection between the outer conductor and strip conductor can be strengthened.

In the high frequency filter according to the present invention, narrow-width portions are provided at the terminals of those located at both ends of said first strip conductors located at both ends and extended to the vicinity of input/output lines; and said input/output lines and said narrow-width portions are connected to each other by capacitors each serving as said input/output coupling means.

In this configuration, said narrow-width portions extended to the vicinity of the input/output line permits the distance between the said input/output line and the resonators to be reduced without increasing unnecessary connection therebetween, thereby directly connecting the electrodes of the capacitor between the input/output line and the resonator.

The high frequency filter according to the present invention comprises:

a strip line type resonator including a dielectric plate, an outer conductor formed on the one surface of said dielectric plate, and a first strip conductor formed on the other surface of said dielectric plate;

a main line of a strip line including said dielectric plate, said outer conductor and a second strip conductor formed on the other surface of said dielectric plate and arranged with an orientation crossing said strip line type resonator in the vicinity of the open end of said strip line type resonator; and a capacitor serving as means for coupling said strip line type resonator with the main line of said strip line, and a narrow-width portion of said strip conductor is provided at the open end of said strip line resonator and extended to the vicinity of said main line, and said main line and said narrow-width portion are connected to each other by a capacitor.

In this configuration, the connection between the main line and the narrow-width portion extended to the vicinity of the input/output line through said capacitor permits the distance between the said input/output line and the resonators to be reduced without increasing unnecessary connection therebetween, thereby directly connecting the electrodes of the capacitor between the input/output line and the resonator.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A high frequency filter comprising:

an input terminal;

an output terminal;

a plurality of first resonators;

a plurality of main coupling means for serially coupling said plurality of first resonators;

a plurality of input/output coupling means for connecting both ends of said serially coupled first resonators to said input terminal and said output terminal, respectively;

a second resonator; and a plurality of jumping coupling means for coupling the first resonators located at both ends of said serially coupled first resonators with said second resonator, wherein said high frequency filter is formed by;

a first dielectric plate, a first outer conductor formed on a first surface of said first dielectric plate, a plurality of first strip conductors formed on a second surface of said first dielectric plate, said plurality of first strip conductors being arranged substantially parallel to each other, a second strip conductor formed in a direction crossing said plurality of first strip conductors, and a first short-circuiting portion for connecting one end of said plurality of first strip conductors to said first outer conductor, wherein each of said plurality of first resonators includes said first dielectric plate, said first outer conductor, one of said plurality of first strip conductors, and said first short-circuiting portion;

said second resonator includes said first dielectric plate, said first outer conductor, and said second strip conductor; and an even number of said plurality of main coupling means are capacitive coupling means and the resonance frequency of said second resonator is set to be higher than the resonance frequency of said first resonators.

2. A high frequency filter comprising:

an input terminal;

an output terminal;

a plurality of first resonators;

a plurality of main coupling means for serially coupling said plurality of first resonators;

a plurality of input/output coupling means for connecting both ends of said serially coupled first resonators to said input terminal and said output terminal, respectively;

a second resonator; and a plurality of jumping coupling means for coupling the first resonators located at both ends of said serially coupled first resonators with said second resonator, wherein said high frequency filter is formed by;

a first dielectric plate, a first outer conductor formed on a first surface of said first dielectric plate, a plurality of first strip conductors formed on a second surface of said first dielectric plate, said plurality of first strip conductors being arranged substantially parallel to each other, a second strip conductor formed in a direction crossing said plurality of first strip conductors, and a first short-circuiting portion for connecting one end of said plurality of first strip conductors to said first outer conductor, wherein each of said plurality of first resonators includes said first dielectric plate, said first outer conductor, one of said plurality of first strip conductors, and said first short-circuiting portion;

said second resonator includes said first dielectric plate, said first outer conductor, and said second strip conductor; and the number of said first resonators is three or more, and the resonance frequency of said second resonator is set to be higher than the resonance frequency of said first resonators.

3. A high frequency filter, comprising:

an input terminal;

an output terminal;

a plurality of first resonators;

a plurality of main coupling means for serially coupling said plurality of first resonators;

a plurality of input/output coupling means for connecting both ends of said serially coupled first resonators to said input terminal and said output terminal, respectively;

a second resonator; and a plurality of jumping coupling means for coupling the first resonators located at both ends of said serially coupled first resonators with said second resonator, wherein said high frequency filter is formed by;

a first dielectric plate, a first outer conductor formed on a first surface of said first dielectric plate, a plurality of first strip conductors formed on a second surface of said first dielectric plate, said plurality of first strip conductors being arranged substantially parallel to each other, a second strip conductor formed in a direction crossing said plurality of first strip conductors, and a first short-circuiting portion for connecting one end of said plurality of first strip conductors to said first outer conductor, wherein each of said plurality of first resonators includes said first dielectric plate, said first outer conductor, one of said plurality of first strip conductors, and said first short-circuiting portion;

said second resonator includes said first dielectric plate, said first outer conductor, and said second strip conductor; and the number of said first resonators is three or more, and the resonance frequency of said second resonator is set to be lower than the resonance frequency of said first resonators.

4. A high frequency filter according to claim 1, wherein both ends of said second strip conductor are opened.

5. A high frequency filter according to claim 4, wherein said second strip conductor is provided with a tip-short-circuited stub branching from its intermediate portion and having a tip connected to said first outer conductor to be short-circuited.

6. A high frequency filter according to claim 4, wherein said second strip conductor is provided with a tip-opened stub branching from its intermediate portion and having an opened tip.

7. A high frequency filter according to claim 1, wherein said high frequency filter is further formed by;

a second dielectric plate, a second outer conductor formed on a first surface of said second dielectric plate, and a plurality of third strip conductors formed on a second surface of said second dielectric plate, said plurality of third strip conductors each having a shape which corresponds to the shape of each of said plurality of first strip conductors;

wherein said first resonators are configured as a plurality of tri-plate line type resonators by stacking said first and second dielectric plates so that said plurality of first strip conductors and said plurality of third strip conductors are opposite and overlay each other; and wherein in order to short-circuit said first strip conductors, a conductor surface is provided on the sides of said first and second dielectric plates.

8. The high frequency filter according to claim 1, further comprising:

a second short-circuiting portion for connecting one end of said second strip conductor to said first outer conductor.

9. A high frequency filter according to claim 8, wherein said second short-circuiting portion connects both ends of said second strip conductor to said first outer conductor.

* * * * *